US010593466B2

(12) United States Patent
Kitajima et al.

(10) Patent No.: US 10,593,466 B2
(45) Date of Patent: Mar. 17, 2020

(54) ELECTRONIC COMPONENT AND METHOD FOR PRODUCING THE SAME

(71) Applicant: MURATA MANUFACTURING CO., LTD., Kyoto (JP)

(72) Inventors: Masaki Kitajima, Nagaokakyo (JP); Yoshiharu Sato, Tsurugashima (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 548 days.

(21) Appl. No.: 15/219,857

(22) Filed: Jul. 26, 2016

(65) Prior Publication Data

US 2016/0336110 A1 Nov. 17, 2016

Related U.S. Application Data

(63) Continuation of application No. PCT/JP2015/051692, filed on Jan. 22, 2015.

(30) Foreign Application Priority Data

Jan. 31, 2014 (JP) ..... 2014-017434

(51) Int. Cl.
*H01F 27/29* (2006.01)
*H01F 17/04* (2006.01)
(Continued)

(52) U.S. Cl.
CPC ..... *H01F 27/292* (2013.01); *H01F 17/04* (2013.01); *H01F 27/2804* (2013.01);
(Continued)

(58) Field of Classification Search
USPC ..... 336/192
See application file for complete search history.

(56) References Cited

U.S. PATENT DOCUMENTS

2008/0257488 A1* 10/2008 Yamano ..... H01F 17/0013 156/272.4
2014/0285306 A1* 9/2014 Sasaki ..... H01F 27/2804 336/200

FOREIGN PATENT DOCUMENTS

JP S59-48001 U 3/1984
JP H09-266133 A 10/1997
(Continued)

OTHER PUBLICATIONS

Written Opinion issued in PCT/JP2015/051692; dated Mar. 10, 2015.
(Continued)

*Primary Examiner* — Mang Tin Bik Lian
*Assistant Examiner* — Kazi S Hossain
(74) *Attorney, Agent, or Firm* — Studebaker & Brackett PC

(57) ABSTRACT

An electronic component including: a body having a shape of a rectangular parallelepiped, the body including a first end surface and a second end surface opposed to each other and a mounting surface; and a first external electrode provided on the first end surface and the mounting surface. A first portion of the first end surface inclines from a direction normal to the mounting surface so as to come closer to the second end surface with decreasing distance from the mounting surface in the normal direction, the first portion being a portion within a predetermined distance from the mounting surface in the normal direction. A thickness of a portion of the first external electrode contacting the first portion becomes greater with decreasing distance from the mounting surface in the normal direction.

3 Claims, 33 Drawing Sheets

(51) Int. Cl.

| | |
|---|---|
| ***H01F 41/04*** | (2006.01) |
| ***H01F 27/28*** | (2006.01) |
| ***H01F 41/02*** | (2006.01) |

(52) U.S. Cl.
CPC ..... *H01F 41/02* (2013.01); *H01F 41/046* (2013.01); *H01F 2017/048* (2013.01); *H01F 2027/2809* (2013.01)

(56) References Cited

FOREIGN PATENT DOCUMENTS

| | | | | |
|---|---|---|---|---|
| JP | 2001-217126 | A | | 8/2001 |
| JP | 2004-015016 | A | | 1/2004 |
| JP | 2006-114626 | A | | 4/2006 |
| JP | 2006114626 | | * | 4/2006 |
| JP | 2007-165477 | A | | 6/2007 |
| JP | 2011-009618 | A | | 1/2011 |
| JP | 2011-109065 | A | | 6/2011 |

OTHER PUBLICATIONS

Notification of the Second Office Action issued by the State Intellectual Property Office of the People's Republic of China dated Dec. 4, 2017, which corresponds to Chinese Patent Application No. 201580006327.2 and is related to U.S. Appl. No. 15/219,857.

An Office Action; "Notice of Reasons for Rejection" issued by the Japanese Patent Office dated Jul. 4, 2017, which corresponds to Japanese Patent Application No. 2014-017434 and is related to U.S. Appl. No. 15/219,857; with English language translation.

International Search Report issued in PCT/JP2015/051692; dated Mar. 10, 2015.

* cited by examiner

ELECTRONIC COMPONENT AND METHOD FOR PRODUCING THE SAME

CROSS REFERENCE TO RELATED APPLICATIONS

This application claims benefit of priority to Japanese Patent Application 2014-017434 filed Jan. 31, 2014, and to International Patent Application No. PCT/JP2015/051692 filed Jan. 22, 2015, the entire content of which is incorporated herein by reference.

TECHNICAL FIELD

The present disclosure relates to an electronic component and a method for producing the same, and more particularly to an electronic component having an external electrode on a surface of a body thereof and a production method thereof.

BACKGROUND

As an example of a conventional electronic component, an inductor component disclosed in Japanese Patent Laid-Open Publication No. 2006-114626 is known. FIG. 26 is a sectional view of the inductor component 500 disclosed in Japanese Patent Laid-Open Publication No. 2006-114626.

The inductor component 500 comprises a body 502 and terminal electrodes 504*a* and 504*b*. The body 502 is in the shape of a rectangular parallelepiped. The terminal electrode 504*a* is provided on the bottom surface and the right surface of the body 502. The terminal electrode 504*b* is provided on the bottom surface and the left surface of the body 502.

In the inductor component 500 disclosed in Japanese Patent Laid-Open Publication No. 2006-114626, the terminal electrodes 504*a* and 504*b* have thinner portions on the edge line between the bottom surface and the right surface of the body 502 and on the edge line between the bottom surface and the left surface of the body 502, respectively, as seen in FIG. 26. Accordingly, the terminal electrodes 504*a* and 504*b* are unlikely to have sufficient strength.

SUMMARY

An object of the present disclosure is to provide an electronic component having an external electrode with enhanced strength and a method for producing the same.

An electronic component according to an embodiment of the present disclosure comprises: a body having a shape of a rectangular parallelepiped, the body including a first end surface and a second end surface opposed to each other and a mounting surface; and a first external electrode provided on the first end surface and the mounting surface, wherein a first portion of the first end surface inclines from a direction normal to the mounting surface so as to come closer to the second end surface with decreasing distance from the mounting surface in the normal direction, the first portion being a portion within a predetermined distance from the mounting surface in the normal direction; and a thickness of a portion of the first external electrode contacting the first portion becomes greater with decreasing distance from the mounting surface in the normal direction.

A method for producing an electronic component according to an embodiment of the present disclosure comprises: making a body having a shape of a rectangular parallelepiped and including a first end surface and a second end surface opposed to each other and a mounting surface; polishing at least a part of the first end surface such that a first portion of the first end surface inclines from a direction normal to the mounting surface so as to come closer to the second end surface with decreasing distance from the mounting surface in the normal direction, the first portion being a portion within a predetermined distance from the mounting surface in the normal direction; and forming a first external electrode extending on the first end surface and the mounting surface by supplying an electrode material, to the mounting surface.

Effect

According to the present disclosure, the strength of the external electrode can be enhanced.

DETAILED DESCRIPTION

An electronic component according to an embodiment of the present disclosure and a method for producing the same will hereinafter be described.

Structure of the Electronic Component

Figure 1A:
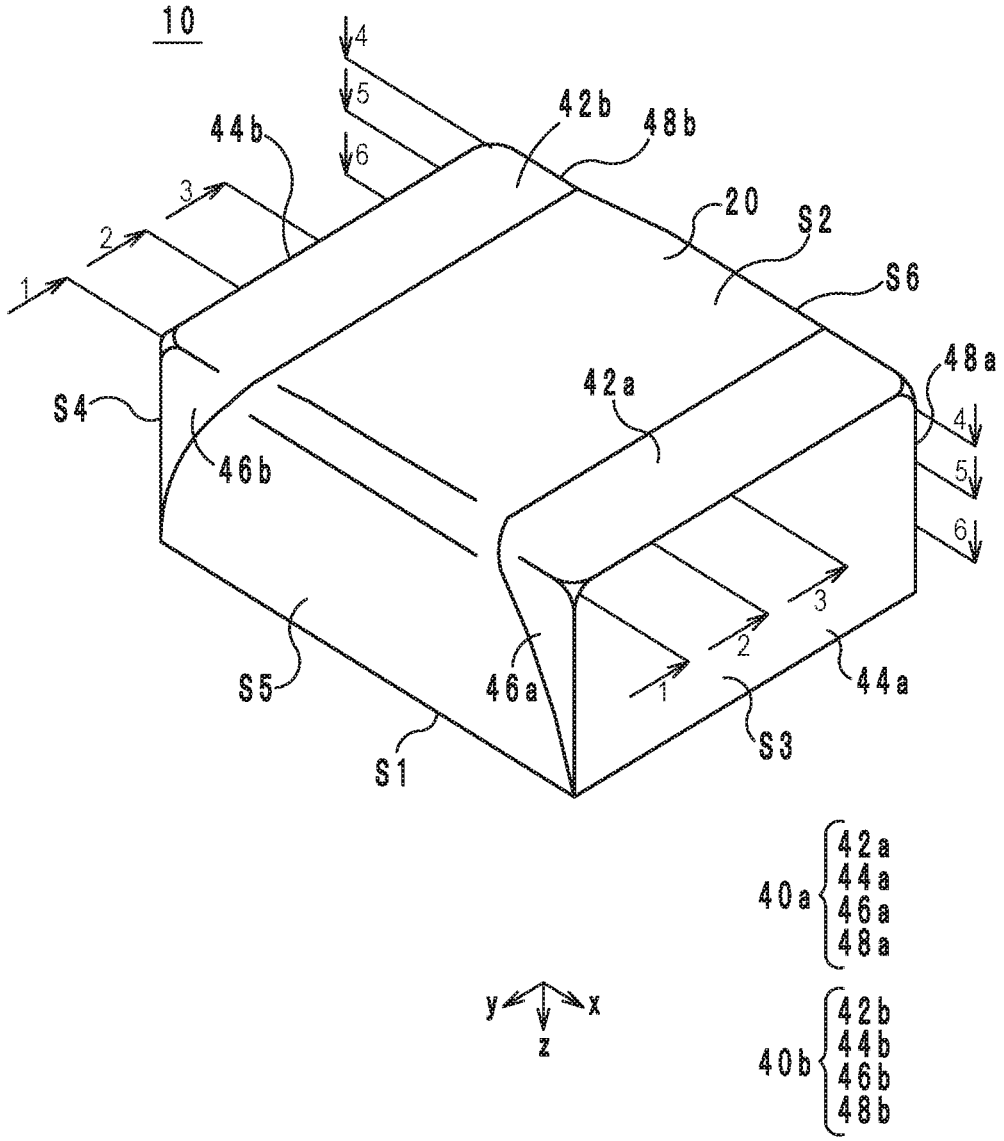
FIG. 1A is a perspective view of an electronic component 10 according to a first embodiment.
Figure 1B:
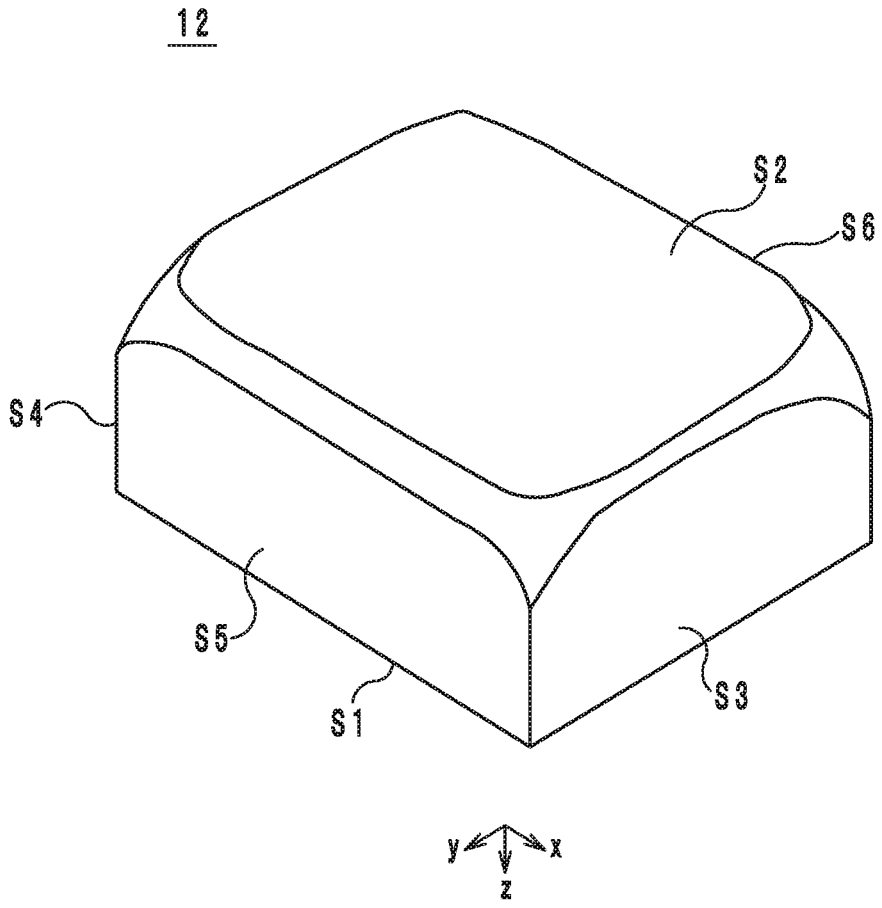
FIG. 1B is a perspective view of a multilayer body 20 of the electronic component 10.
Figure 2:
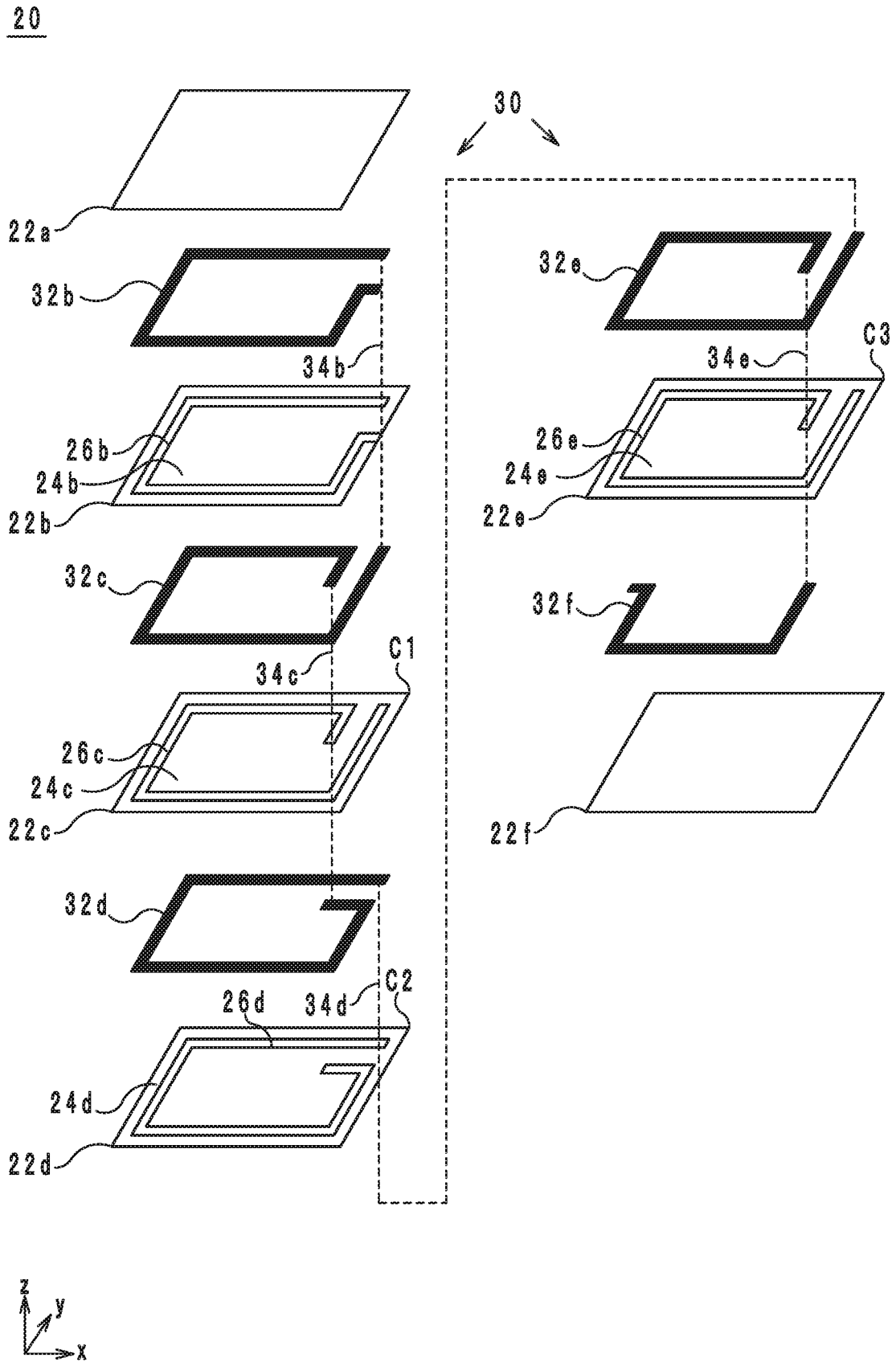
FIG. 2 is an exploded perspective view of the multilayer body 20 of the electronic component 10.
Figure 3A:
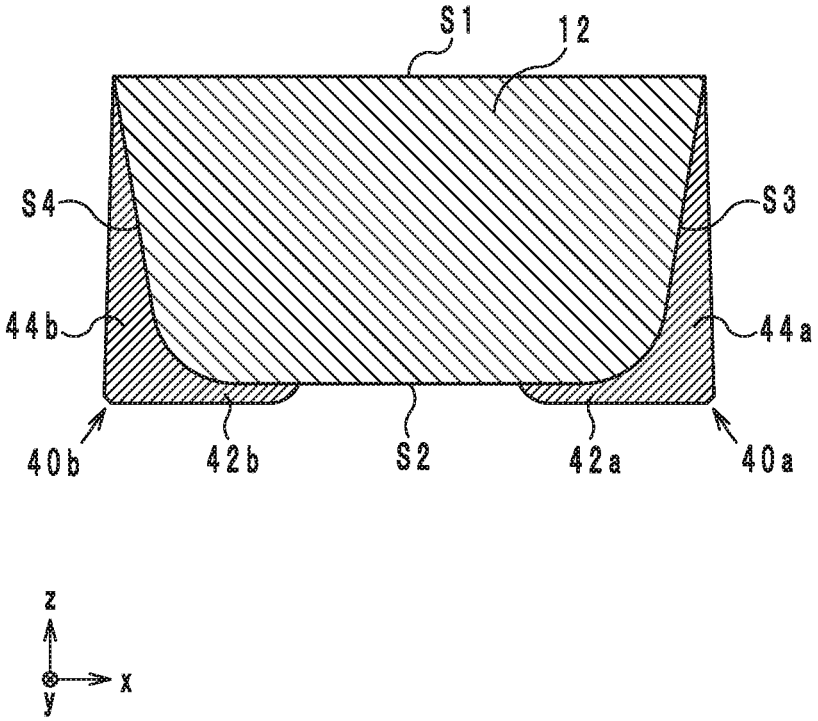
FIG. 3A is a sectional view of the electronic component 10, cut along the line 1-1.
Figure 3B:
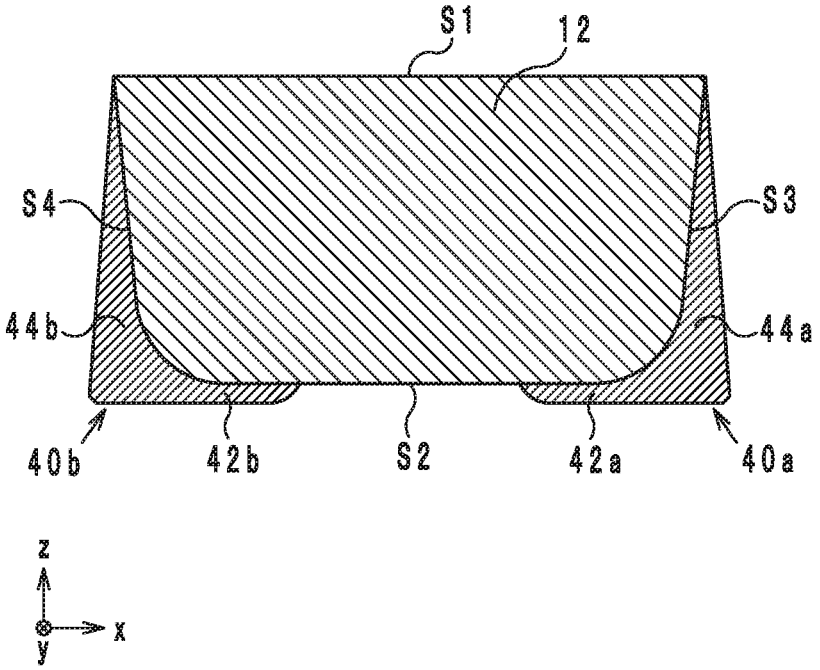
FIG. 3B is a sectional view of the electronic component 10, cut along the line 2-2.
Figure 3C:
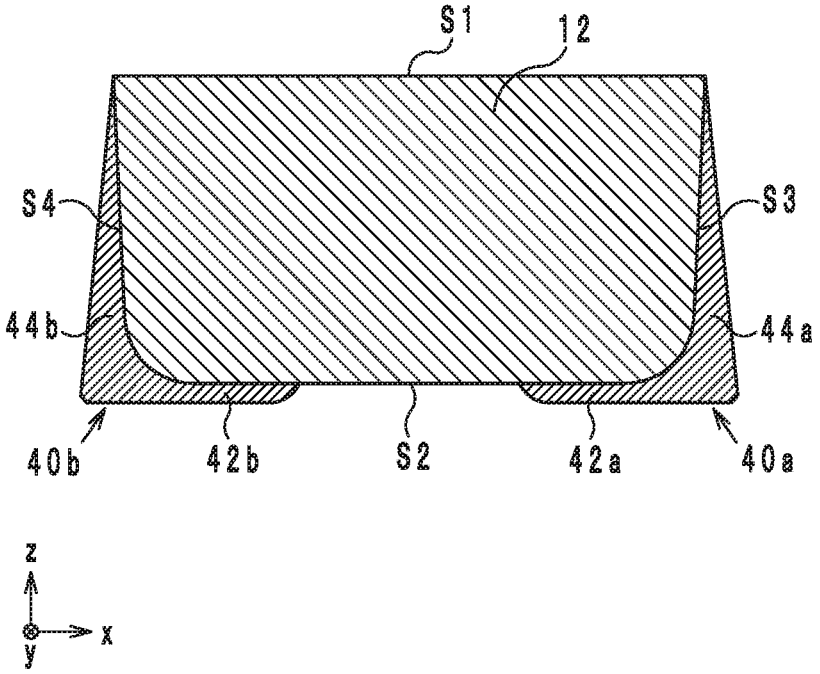
FIG. 3C is a sectional view of the electronic component 10, cut along the line 3-3.
Figure 3D:
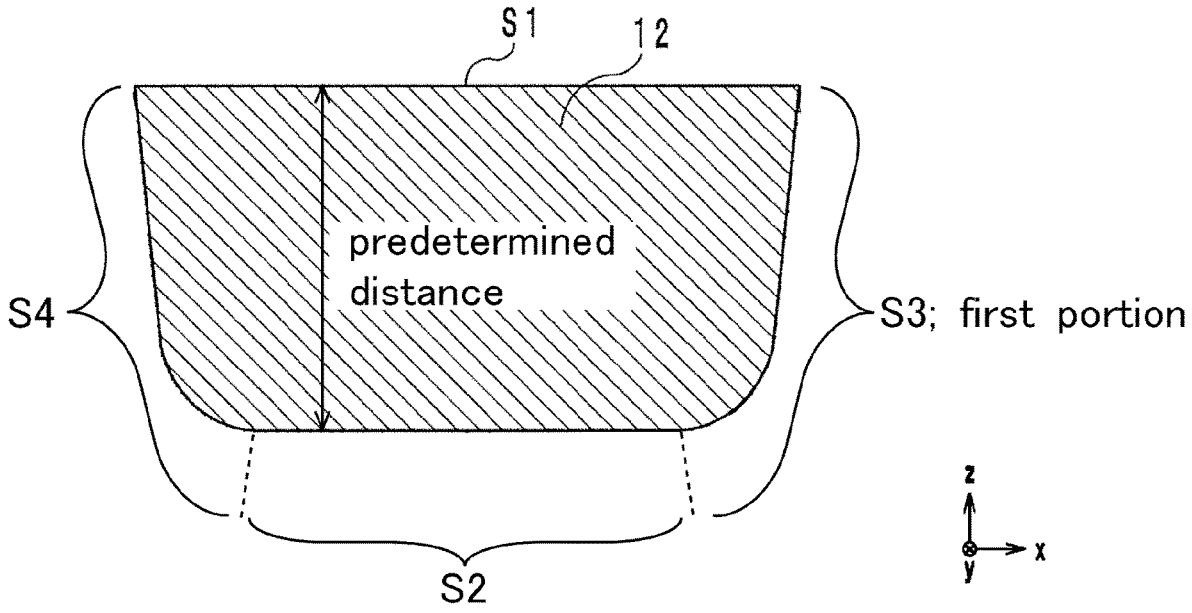
FIG. 3D is an annotated version of FIG. 3B from which the external electrodes 40*a* and 40*b* are eliminated.
Figure 3E:
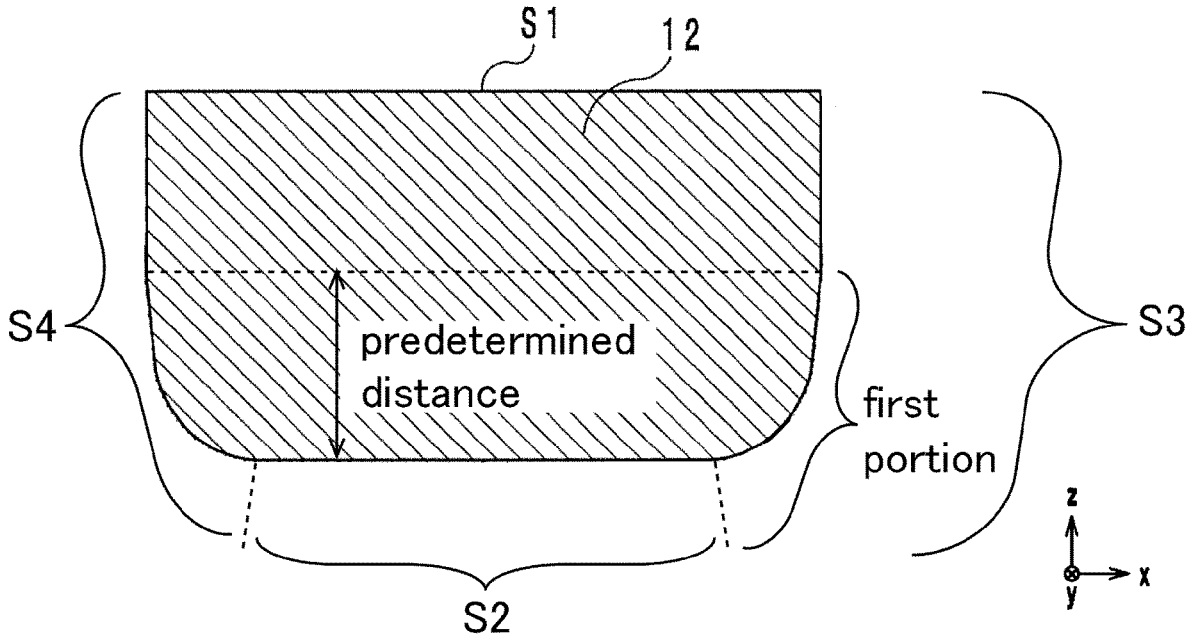
FIG. 3E corresponds to an embodiment in which only a part of the end surface S3 is inclined from the z-direction.
Figure 4A:
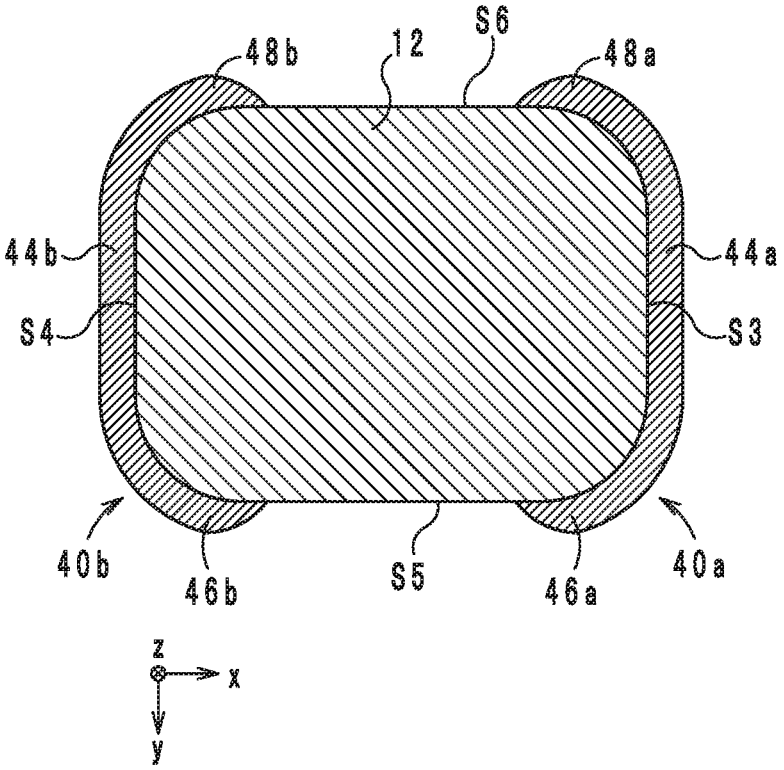
FIG. 4A is a sectional view of the electronic component 10, cut along the line 4-4.
Figure 4B:
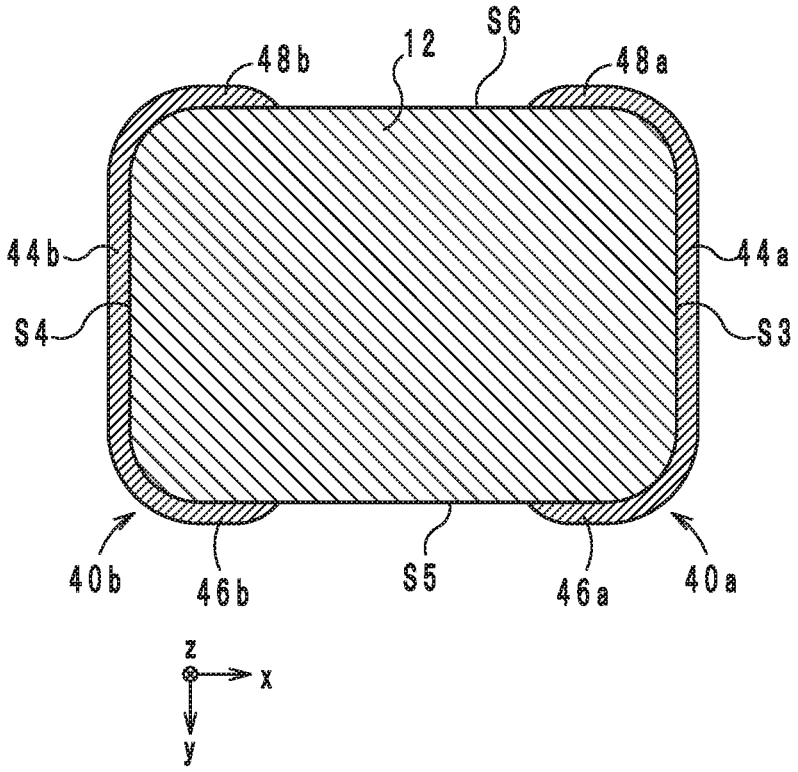
FIG. 4B is a sectional view of the electronic component 10, cut along the line 5-5.
Figure 4C:
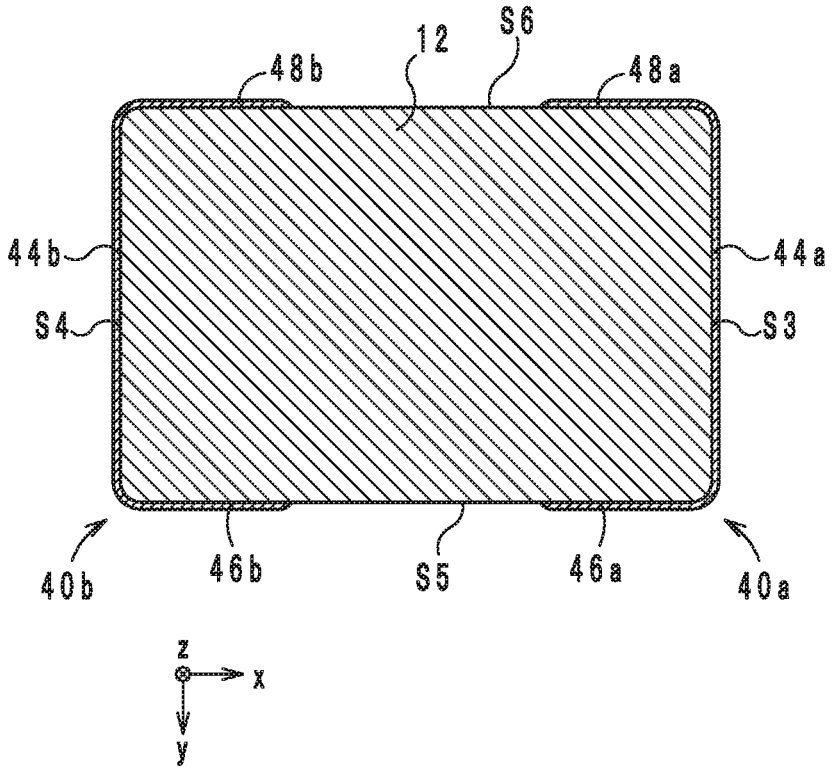
FIG. 4C is a sectional view of the electronic component 10, cut along the line 6-6.

The structure of an electronic component according to an embodiment will hereinafter be described with reference to the drawings. FIG. 1A is a perspective view of an electronic component 10 according to an embodiment. FIG. 1B is a perspective view of a multilayer body 20 of the electronic component 10. FIG. 2 is an exploded perspective view of the multilayer body 20. FIG. 3A is a sectional view of the electronic component 10, cut along the line 1-1. FIG. 3B is a sectional view of the electronic component 10, cut along the line 2-2. FIG. 3C is a sectional view of the electronic component 10, cut along the line 3-3. FIG. 3D is an annotated version of FIG. 3B from which the external electrodes 40*a* and 40*b* are eliminated. FIG. 3E corresponds to an embodiment in which only a part of the end surface S3 is inclined from the z-direction. FIG. 4A is a sectional view of the electronic component 10, cut along the line 4-4. FIG. 4B is a sectional view of the electronic component 10, cut along the line 5-5. FIG. 4C is a sectional view of the electronic component 10, cut along the line 6-6. In FIGS. 3A-3E and 4A-4C, the internal structure of the multilayer body 20 is not illustrated.

The layer stacking direction of the electronic component 10 will hereinafter be referred to as the z-direction. When the electronic component 10 is viewed from the z-direction, the direction along the long sides of the electronic component 10 will hereinafter be referred to as the x-direction, and the direction along the short sides of the electronic component 10 will hereinafter be referred to as the y-direction. The x-direction, the y-direction and the z-direction are orthogonal to one another.

The electronic component 10 comprises a multilayer body 20, a coil 30, and external electrodes 40*a* and 40*b*.

As illustrated in FIGS. 1B and 2, the multilayer body 20 includes insulating layers 22*a*-22*f* stacked in this order from a positive side to a negative side in the z-direction, and the multilayer body 20 is in the shape of a rectangular parallelepiped. The surface of the multilayer body 20 on the positive side in the z-direction will be referred to as a top surface S1, and the surface of the multilayer body 20 on the negative side in the z-direction will be referred to as a bottom surface S2. The z-direction is parallel to the direction normal to the bottom surface S2. The surface of the multilayer body 20 on the positive side in the x-direction will be referred to as an end surface S3, and the surface of the multilayer body 20 on the negative side in the x-direction will be referred to as an end surface S4. The surfaces S3 and S4 are opposed to each other in the x-direction. The surface of the multilayer body 20 on the positive side in the y-direction will be referred to as a side surface S5, and the surface of the multilayer body 20 on the negative side in the y-direction will be referred to as a side surface S6. The surfaces S5 and S6 are opposed to each other in the y-direction.

As seen in FIGS. 3A-3C, however, when the multilayer body 20 is viewed from the y-direction, the end surface S3 inclines slightly to the negative side in the x-direction as extending toward the negative side in the z-direction. In other words, the end surface S3 inclines from the z-direction so as to come closer to the end surface S3 with decreasing distance from the bottom surface S2.

As seen in FIGS. 2 and 3A-3C, the edge line between the end surface S3 and the bottom surface S2 is chamfered. Accordingly, the joint portion between the end surface S3 and the bottom surface S2 is rounded off. As seen in FIGS. 2 and 4A-40, the edge line between the end surface S3 and the side surface S5 is chamfered. As seen in FIGS. 2 and 4A-4C, the edge line between the end surface S3 and the side surface S6 is chamfered in the same manner. Accordingly, the joint portion between the end surface S3 and the side surface S5 and the joint portion between the end surface S3 and the side surface S6 are rounded off. The diameter of the chamfered joint portion between the end surface S3 and the side surface S5 and the diameter of the chamfered joint portion between the end surface S4 and the side surface S6 become larger as the chamfered joint portions extend toward the negative side in the z-direction (that is, with decreasing distance from the bottom surface S2).

As seen in FIGS. 3A-3C, when the multilayer body 20 is viewed from the y-direction, the end surface S4 inclines slightly to the positive side in the x-direction as extending toward the negative side in the z-direction. In other words, the end surface S4 inclines from the z-direction so as to come closer to the end surface S3 with decreasing distance from the bottom surface S2.

As seen in FIGS. 2 and 3A-3C, the edge line between the end surface S4 and the bottom surface S2 is chamfered. Accordingly the joint portion between the end surface S4 and the bottom surface S2 is rounded off. As seen in FIGS. 2 and 4A-4C, the edge line between the end surface S4 and the side surface S5 is chamfered. As seen in FIGS. 2 and 4A-4C, the edge line between the end surface S4 and the side surface S6 is chamfered in the same manner. Accordingly, the joint portion between the end surface S4 and the side surface S5 and the joint portion between the end surface S4 and the side surface S6 are rounded off. The diameter of the chamfered joint portion between the end surface S4 and the side surface S5 and the diameter of the chamfered joint portion between the end surface S4 and the side surface S6 become larger as the chamfered joint portions extend toward the negative side in the z-direction (that is, with decreasing distance from the bottom surface S2).

Each of the insulating layers 22*a*-22*f* is rectangular when viewed from the z-direction. The insulating layers 22*a*-22*f* are made of resin containing particles of a metal magnetic material. The metal magnetic material is, for example, a Fe—Si—Cr alloy, Fe (carbonyl) or the like. The resin is, for example, epoxy resin. The particles of a metal magnetic material may be coated with an insulating material such as glass, resin or the like. Alternatively, the surfaces of the particles may be reformed, for example, may be oxidized.

As illustrated in FIG. 2, the insulating layer 22*a* is located on the most positive side in the z-direction of the multilayer body 20. The insulating layer 22*a* is made of a magnetic material.

The insulating layer 22*b* is located on the negative side in the z-direction of the insulating layer 22*a* so as to be adjacent to the insulating layer 22*a*. The insulating layer 22*b* includes a magnetic portion 24*b* made of a magnetic material, and a non-magnetic portion 26*b* made of a non-magnetic material. The non-magnetic portion 26*b* is a strip-shaped portion extending in parallel to the outer edge of the insulating layer 22*b*. When the insulating layer 22*h* is viewed from the z-direction, the non-magnetic portion 26*b* is shaped of a rectangular frame with a missing part, and the magnetic portion 24*b* lies outside and inside the non-magnetic portion 26*b*.

The insulating layer 22*c* is located on the negative side in the z-direction of the insulating layer 22*b* so as to be adjacent to the insulating layer 22*b*. The insulating layer 22*c* includes a magnetic portion 24*c* made of a magnetic material, and a non-magnetic portion 26*c* made of a non-magnetic material. The non-magnetic portion 26*c* is a strip-shaped portion extending in parallel to the outer edge of the insulating layer 22*c*. When the insulating layer 22*c* is viewed from the z-direction, the non-magnetic portion 26*c* is shaped of a rectangular frame with a missing part, and the magnetic portion 24*c* lies outside and inside the non-magnetic portion 26*c*.

The insulating layer 22*d* is located on the negative side in the z-direction of the insulating layer 22*c* so as to be adjacent to the insulating layer 22*c*. The insulating layer 22*d* includes a magnetic portion 24*d* made of a magnetic material, and a non-magnetic portion 26*d* made of a non-magnetic material. The non-magnetic portion 26*d* is a strip-shaped portion extending in parallel to the outer edge of the insulating layer 22*d*. When the insulating layer 22*d* is viewed from the z-direction, the non-magnetic portion 26*d* is shaped of a rectangular frame with a missing part, and the magnetic portion 24*d* lies outside and inside the non-magnetic portion 26*d*.

The insulating layer 22*e* is located on the negative side in the z-direction of the insulating layer 22*e* so as to be adjacent to the insulating layer 22*d*. The insulating layer 22*e* includes a magnetic portion 24*e* made of a magnetic material, and a non-magnetic portion 26*e* made of a non-magnetic material. The non-magnetic portion 26*e* is a strip-shaped portion extending in parallel to the outer edge of the insulating layer 22*e*. When the insulating layer 22*e* is viewed from the z-direction, the non-magnetic portion 26*e* is shaped of a rectangular frame with a missing part, and the magnetic portion 24*e* lies outside and inside the non-magnetic portion 26*e*.

The insulating layer 22*f* is located on the most negative side in the z-direction of the multilayer body 20. The insulating layer 22*f* is made of a magnetic material.

When viewed from the z-direction, the non-magnetic portions 26*b*-26*e* overlap one another and form a rectangular trace.

As illustrated in FIG. 2, the coil 30 is embedded in the multilayer body 20. The coil 30 comprises coil conductors 32*b*-32*f* and via conductors 34*b*-34*e*. The coil 30 is spiral, and the central axis of the spiral is parallel to the z-direction. Thus, when viewed from the positive side in the z-direction, the coil 30 spirals from the positive side to the negative side in the z-direction while circling clockwise. The coil 30 is made of a conductive material, such as Au, Ag, Pd, Cu, Ni or the like.

The coil conductor 32*b* is a linear conductor arranged to extend along the non-magnetic portion 26*b*. Specifically, when viewed from the z-direction, the coil conductor 32*b* is shaped of a rectangular frame with a missing part as is with the non-magnetic portion 26*b*, and lies over the non-magnetic portion 26*b*. A first end of the coil conductor 32*b* is exposed on the end surface S3 located on the positive side in the x-direction of the multilayer body 20 through the positive side in the x-direction of the insulating layer 22*b*. A second end of the coil conductor 32*b* is located near a corner between the positive side in the x-direction and the positive side in the y-direction of the insulating layer 22*b* and is connected to the via conductor 34*b* piercing through the insulating layer 22*b* in the z-direction.

The coil conductor 32*c* is a linear conductor arranged to extend along the non-magnetic portion 26*c*. Specifically, when viewed from the z-direction, the coil conductor 32*c* is shaped of a rectangular frame with a missing part as is the case with the non-magnetic portion 26*c*, and lies over the non-magnetic portion 26*c*. A first end of the coil conductor 32*c* is located near a corner C1 between the positive side in the x-direction and the positive side in the y-direction of the insulating layer 22*c* and is connected to the via conductor 34*b*. A second end of the coil conductor 32*c* is located near the corner C1 but closer to the center of the insulating layer 22*c* than the first end of the coil conductor 32*c*, and is connected to the via conductor 34*c* piercing through the insulating layer 22*c* in the z-direction.

The coil conductor 32*d* is a linear conductor arranged to extend along the non-magnetic portion 26*d*. Specifically when viewed from the z-direction, the coil conductor 32*d* is shaped of a rectangular frame with a missing part as is the case with the non-magnetic portion 26*d*, and lies over the non-magnetic portion 26*d*. A first end of the coil conductor 32*d* is located near a corner C2 between the positive side in the x-direction and the positive side in the y-direction of the insulating layer 22*d* and is connected to the via conductor 34*c*. A second end of the coil conductor 32*d* is located near the corner C2 and closer to the outer edge of the insulating layer 22*d* than the first end of the coil conductor 32*d*, and is connected to the via conductor 34*d* piercing through the insulating layer 22*d* in the z-direction.

The coil conductor 32*e* is a linear conductor arranged to extend along the non-magnetic portion 26*e*. Specifically, when viewed from the z-direction, the coil conductor 32*e* is shaped of a rectangular frame with a missing part as is the case with the non-magnetic portion 26*e*, and lies over the non-magnetic portion 26*e*. A first end of the coil conductor 32*e* is located near a corner C3 between the positive side in the x-direction and the positive side in the y-direction of the insulating layer 22*e* and is connected to the via conductor 34*d*. A second end of the coil conductor 32*e* is located near the corner C3 but closer to the center of the insulating layer 22*e* than the first end of the coil conductor 32*e*, and is connected to the via conductor 34*e* piercing through the insulating layer 22*e* in the z-direction.

The coil conductor 32*f* is a square U-shaped linear conductor when viewed from the z-direction. Specifically, the coil conductor 32*f* extends along the positive and negative sides in the x-direction and the negative side in the y-direction of the insulating layer 22*f*. A first end of the coil conductor 32*f* is located near a corner between the positive side in the x-direction and the positive side in the y-direction of the insulating layer 22*f* and is connected to the via conductor 34*e*. A second end of the coil conductor 32*f* is exposed on the end surface S4 located on the negative side in the x-direction of the multilayer body 20 through the negative side in the x-direction of the insulating layer 22*f*.

Thus, when viewed from the z-direction, the coil conductors 32*b*-32*f* overlap one another and circle along the rectangular trace formed of the non-magnetic portions 26*b*-26*e*. The coil conductors 32*b*-32*f* and the non-magnetic portions 26*b*-26*e* are arranged alternately in the z-direction.

As illustrated in FIG. 1A, the external electrodes 40*a* and 40*b* are metal external terminals provided on the surface of the multilayer body 20. More specifically, the external electrode 40*a* is provided to extend from the bottom surface S2 of the multilayer body 20 to the adjacent end and side surfaces S3. S5 and S6. The external electrode 40*a* is connected to the first end of the coil conductor 32*b*. The portion of the external electrode 40*a* in contact with the bottom surface S2 will hereinafter be referred to as a contact portion 42*a*. The portion of the external electrode 40*a* in contact with the end surface S3 will hereinafter be referred to as a contact portion 44*a*. The portion of the external electrode 40*a* in contact with the side surface S5 will hereinafter be referred to as a contact portion 46*a*. The portion of the external electrode 40*a* in contact with the side surface S6 will hereinafter be referred to as a contact portion 48*a*.

The contact portion 42*a* is a rectangular portion covering the short side on the positive side in the x-direction of the bottom surface S2 and the neighborhood thereof. The contact portion 44*a* is a rectangular portion covering almost the entire end surface S3. The contact portion 46*a* is a triangular portion covering the short side on the positive side in the x-direction of the side surface S5 and the neighborhood thereof, and the positive end portion in the x-direction of the long side on the negative side in z-direction of the side surface S5 and the neighborhood thereof. The contact portion 48*a* is a triangular portion covering the short side on the positive side in the x-direction of the side surface S6 and the neighborhood thereof, and the positive end portion in the x-direction of the long side on the negative side in the z-direction of the side surface S6 and the neighborhood thereof.

As seen in FIGS. 3A-3C and 4A-4C, the contact portion 44*a* becomes thicker as extending toward the negative side in the z-direction. In other words, the thickness of the contact portion 44*a* becomes greater with decreasing distance from the bottom surface S2 in the z-direction. Therefore, a cross section of the contact portion 44*a* in a plane perpendicular to the y-direction is triangular. Accordingly, the thickness of the contact portion 44*a* is the maximum at the long side on the negative side in the z-direction of the end surface S3.

As seen in FIGS. 3A-3C and 4A-4C, the contact portions 46*a* and 48*a* become thicker as extending toward the negative side in the z-direction. In other words, the thickness of each of the contact portions 46*a* and 48*a* becomes greater with decreasing distance from the bottom surface S2 in the z-direction. Therefore a cross section of each of the contact portions 46*a* and 48*a* in a plane perpendicular to the x-direction is triangular. Accordingly, the thickness of each of the contact portions 46*a* and 48*a* is the maximum at the long side on the negative side in the z-direction of each of the side surfaces S5 and S6.

The external electrode 40*b* is provided to extend from the bottom surface S2 to the adjacent end and side surfaces S4, S5 and S6. The external electrode 40*a* is connected to the second end of the coil conductor 32*f*. Hence, the coil 30 is electrically connected between the external electrodes 40*a* and 40*b*. The portion of the external electrode 40*b* in contact with the bottom surface S2 will hereinafter be referred to as a contact portion 42*b*. The portion of the external electrode 40*b* in contact with the end surface S3 will hereinafter be referred to as a contact portion 44*b*. The portion of the external electrode 40*b* in contact with the side surface S5 will hereinafter be referred to as a contact portion 46*b*. The portion of the external electrode 40*b* in contact with the side surface S6 will hereinafter be referred to as a contact portion 48*b*.

The contact portion 42*b* is a rectangular portion covering the short side on the negative side in the x-direction of the bottom surface S2 and the neighborhood thereof. The contact portion 44*b* is a rectangular portion covering almost the entire end surface S4. The contact portion 46*b* is a triangular portion covering the short side on the negative side in the x-direction of the side surface S5 and the neighborhood thereof, and the negative end portion in the x-direction of the long side on the negative side in the z-direction of the side surface S5 and the neighborhood thereof. The contact portion 48*b* is a triangular portion covering the short side on the negative side in the x-direction of the side surface S6 and the neighborhood thereof, and the negative end portion in the x-direction of the long side on the negative side in the z-direction of the side surface S6 and the neighborhood thereof.

As seen in FIGS. 3A-3C and 4A-4C, the contact portion 44*b* becomes thicker as extending toward the negative side in the z-direction. In other words, the thickness of the contact portion 44*b* becomes greater with decreasing distance from the bottom surface S2 in the z-direction. Therefore, a cross section of the contact portion 44*b* in a plane perpendicular to the y-direction is triangular. Accordingly the thickness of the contact portion 44*b* is the maximum at the long side on the negative side in z-direction of the end surface S4.

As seen in FIGS. 3A-3C and 4A-4C, the contact portions 46*b* and 48*b* become thicker as extending toward the negative side in the z-direction. In other words, the thickness of each of the contact portions 46*b* and 48*b* becomes greater with decreasing distance from the bottom surface S2 in the z-direction. Therefore, a cross section of each of the contact portions 46*b* and 48*b* in a plane perpendicular to the x-direction is triangular. Accordingly, the thickness of each of the contact portions 46*b* and 48*b* is the maximum at the long side on the negative side in the z-direction of each of the side surfaces S5 and S6. The external electrodes 40*a* and 40*b* structured above are made of Cu, Ag or an alloy of Cu and Ag.

The electronic component 10 having the structure above is mounted on a circuit board in such a way that the bottom surface S2 of the multilayer body 20 faces the circuit board. Thus, the bottom surface S2 of the multilayer body 20 is a mounting surface.

Production Method of the Electronic Component

Figure 23:
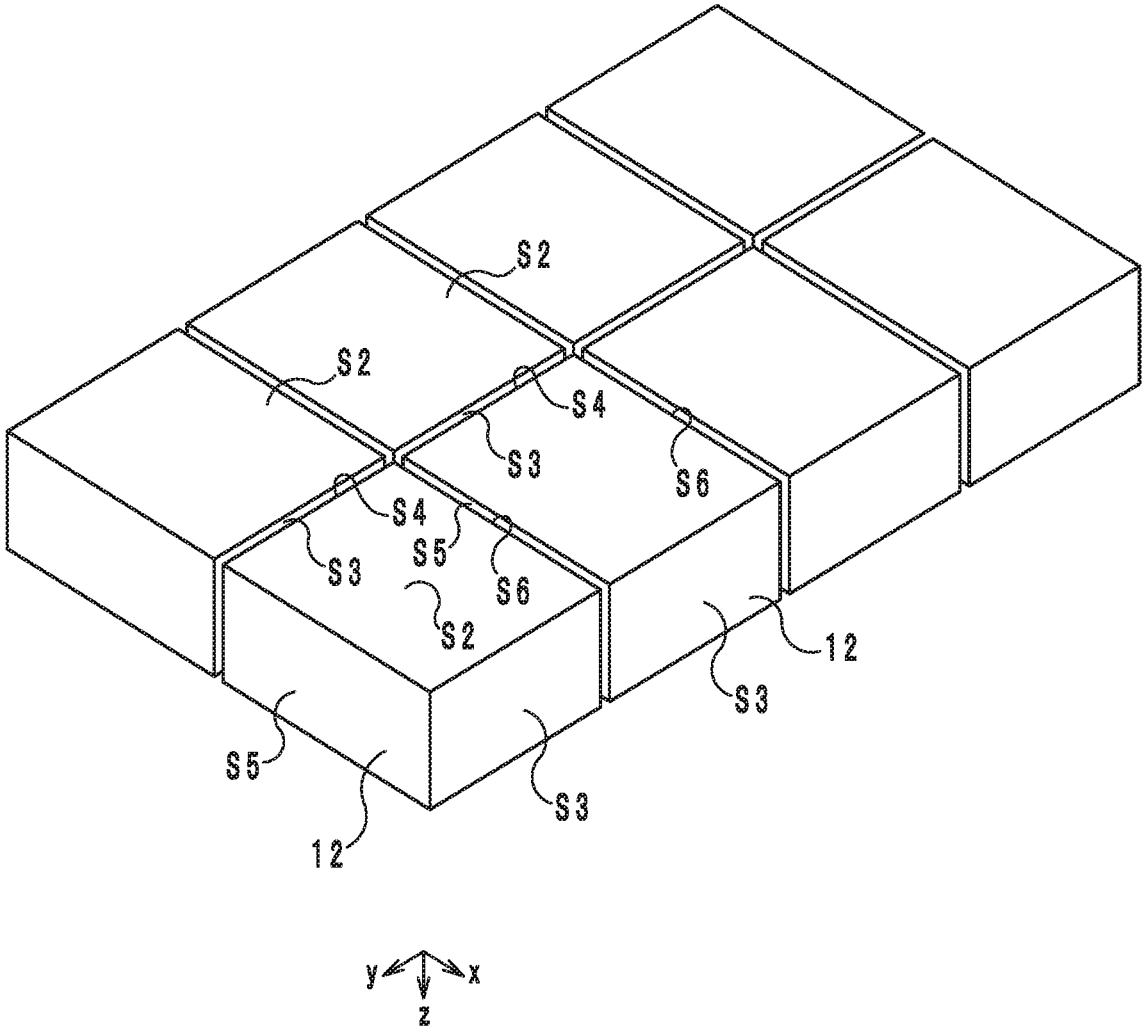
FIG. 23 is a perspective view of the electronic component 10 during the production process thereof.
Figure 24:
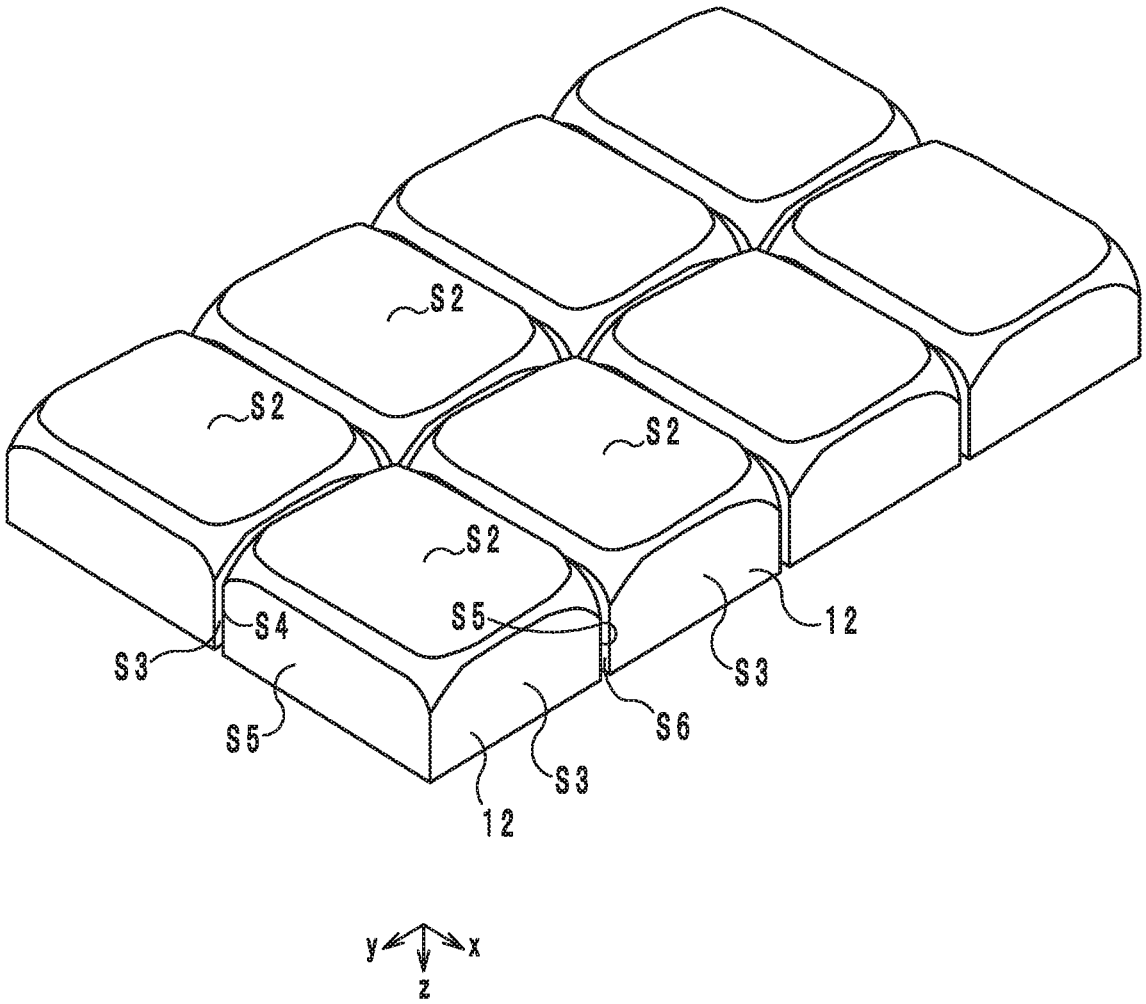
FIG. 24 is a perspective view of the electronic component 10 during the production process thereof.
Figure 25:
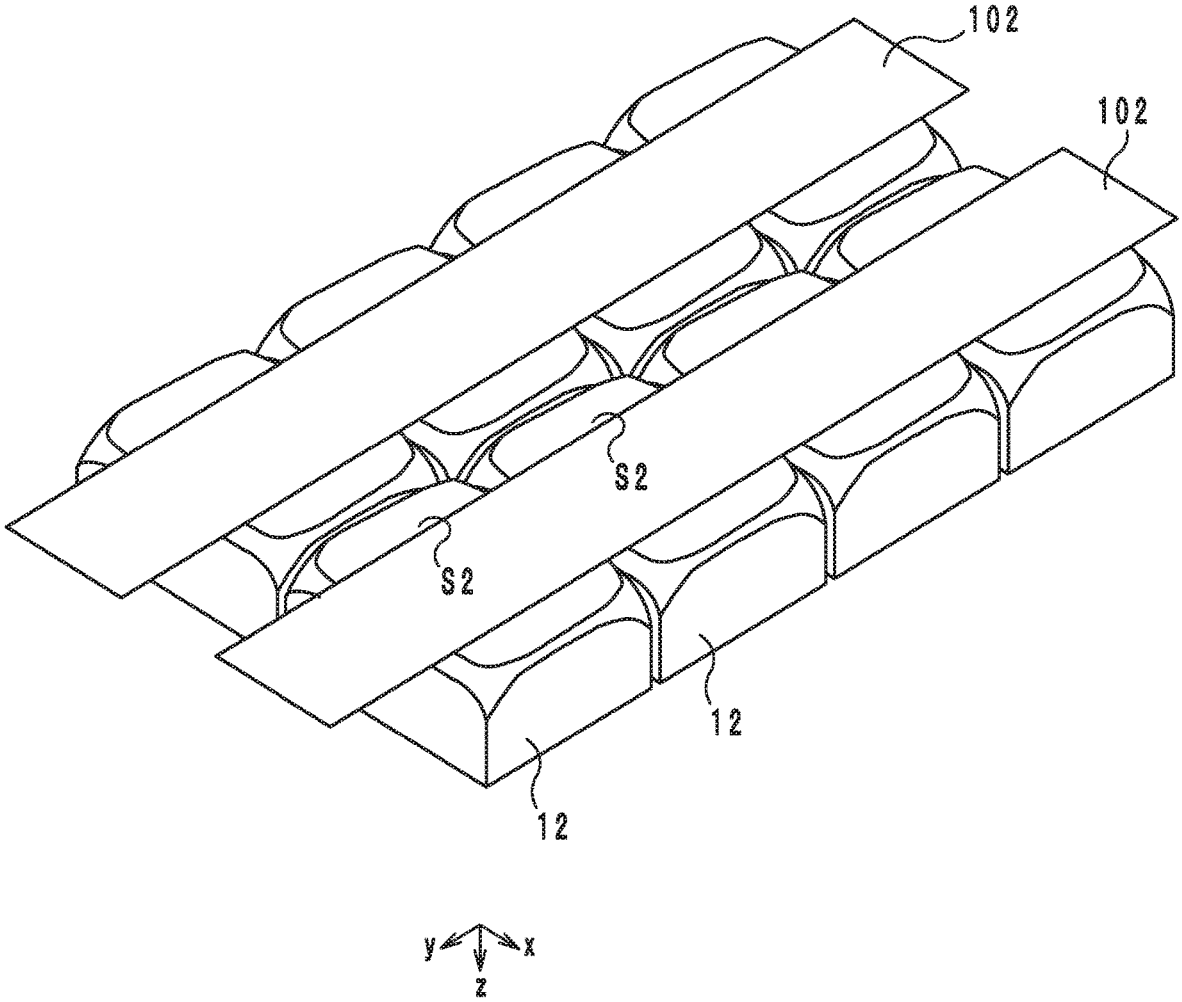
FIG. 25 is a perspective view of the electronic component 10 during the production process thereof.
Figure 26:
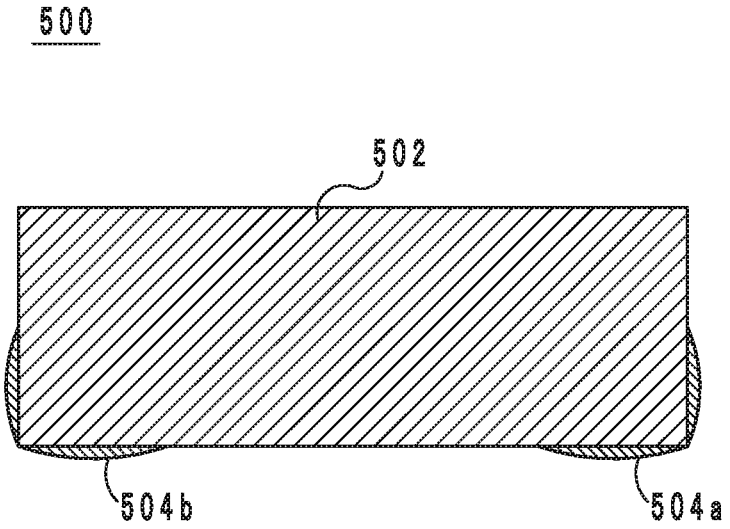
Fig. 26 PRIOR ART
FIG. 26 is a sectional view of an inductor component 500 disclosed in Japanese Patent Laid-Open Publication No. 2006-114626.

Next, a production method of the electronic component 10 is described. FIGS. 5-22 are sectional views of the electronic component 10 at respective steps of a production process thereof. FIGS. 23-25 are perspective views of the electronic component 10 during the production process.

First, a thermoplastic resin sheet containing a filler (which will hereinafter be referred to as a resin sheet) 260*f* is prepared. The filler contained in the resin sheet 260*f* is microparticles of an insulating material, such as silica, silicon carbide, alumina or the like. The main component of the resin may be epoxy resin or the like.

Figure 5:
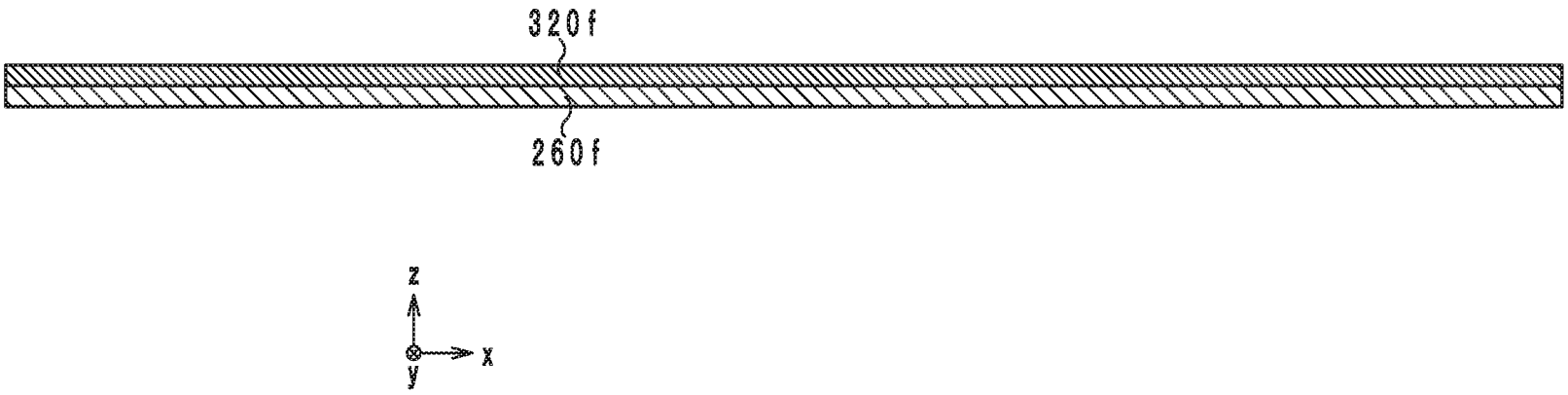
FIG. 5 is a sectional view of the electronic component 10 at a step of a production process thereof.

Next, as illustrated in FIG. 5, a Cu foil 320*f* is placed on the resin sheet 260*f*, and the Cu foil 320*f* and the resin sheet 260*f* are pressure-bonded together. In this regard, in order to release gas from the interface between the resin sheet 260*f* and the Cu film 320*f* also, it is preferred that a vacuum thermal press machine is used. For example, the pressure bonding is carried out in the following way. Under temperature of 90 to 200 degrees C., vacuuming is carried out for 1 to 30 minutes, and pressure of 0.5 to 10 MPa is applied for 1 to 120 minutes. The pressure bonding may be carried out by use of a roller, a high-temperature press machine or the like.

After the pressure bonding, in order to harden the resin sheet 260*f*, a thermal treatment is applied. The thermal treatment is carried out in an oven or any other high-temperature chamber, for example, under temperature of 130 to 200 degrees C. for 10 to 120 minutes.

After the thermal treatment, in order to adjust the thickness of the press-bonded Cu film 320*f*, electrolytic copper plating is applied. Specifically, in preparation for plating, the resin sheet 260*f* with the Cu film 320*f* pressure-bonded thereto is dipped in an acid cleaner to remove the acid coating on the Cu film 320*f*. Next, by use of a plating bath mainly containing a copper sulfate solution, electrolytic copper plating is applied onto the Cu film 320*f* in a constant-current mode. After the electrolytic copper plating, the resin sheet 260*f* and the Cu film 320*f* bonded together are washed with water and dried. Further, in order to reduce the risk of substrate warping after the plating, a thermal treatment is carried out in an oven or any other high-temperature chamber, for example, under temperature of 150 to 250 degrees C. for 60 to 180 minutes. In the production process according to this embodiment, the electrolytic copper plating may be replaced with vapor deposition, sputtering or the like.

Figure 6:
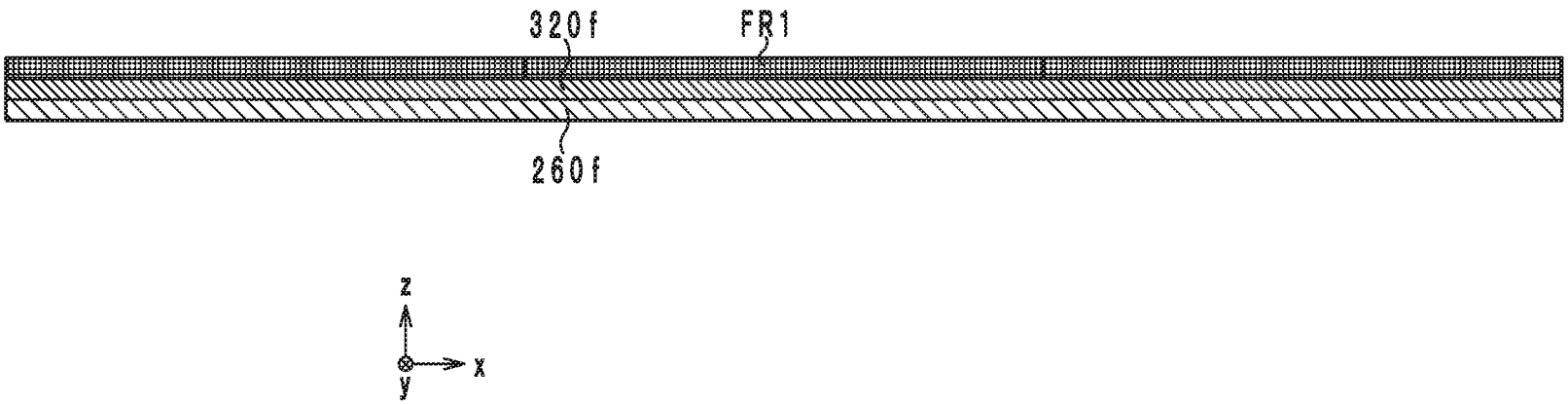
FIG. 6 is a sectional view of the electronic component 10 at a step of the production process thereof.
Figure 7:
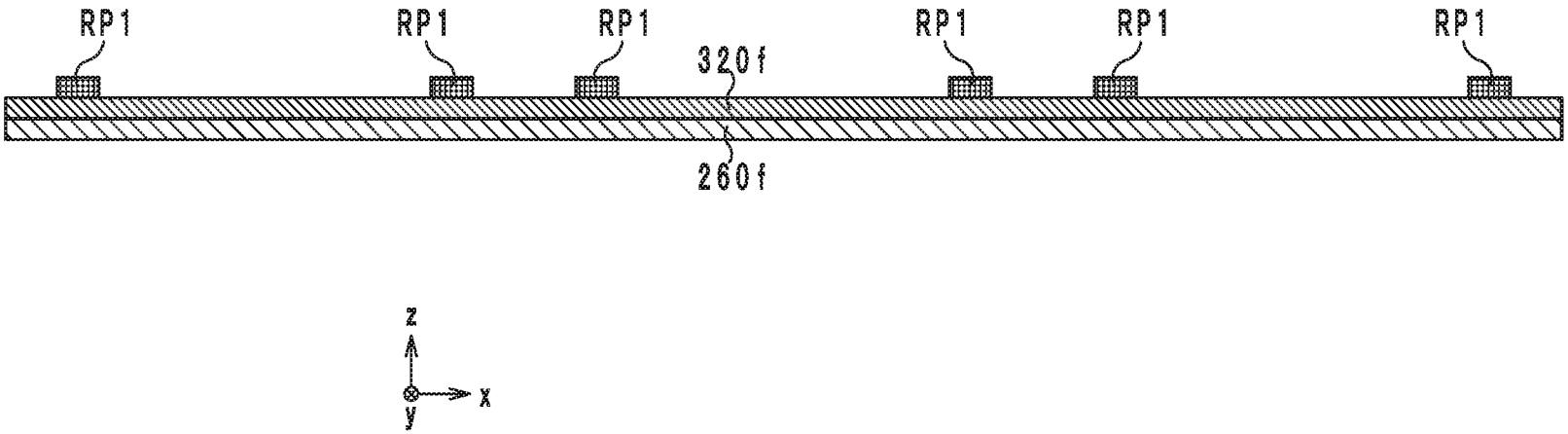
FIG. 7 is a sectional view of the electronic component 10 at a step of the production process thereof.

After the adjustment of the thickness of the Cu foil 320*f*, a resist pattern RP1 is formed on the Cu foil. 320*f*. The resist pattern RP1 is formed in the following way. First, in order to permit strong adhesion between the resist pattern RP1 and the Cu foil 320*f*, the surface of the Cu foil 320*f* is roughened by use of a buffing machine, and thereafter, is washed with water and dried. Alternatively milling, etching or the like may be adopted to roughen the surface of the Cu foil 320*f*. Next, as illustrated in FIG. 6, a film resist FR1 is laminated on the Cu foil 320*f*. Then, the film resist FR1 is exposed to light via a film mask, thereby hardening the exposed portion of the film resist FR1. After the hardening of the film resist FR1, the film resist FR1 is developed by using sodium carbonate as a developer so as to remove the unhardened portion of the film resist FR1. In this way, the resist pattern RP1 is formed on the Cu foil 320*f* as illustrated in FIG. 7. Thereafter, the developer is rinsed off with water, and the resin sheet 260*f* is dried.

Figure 8:
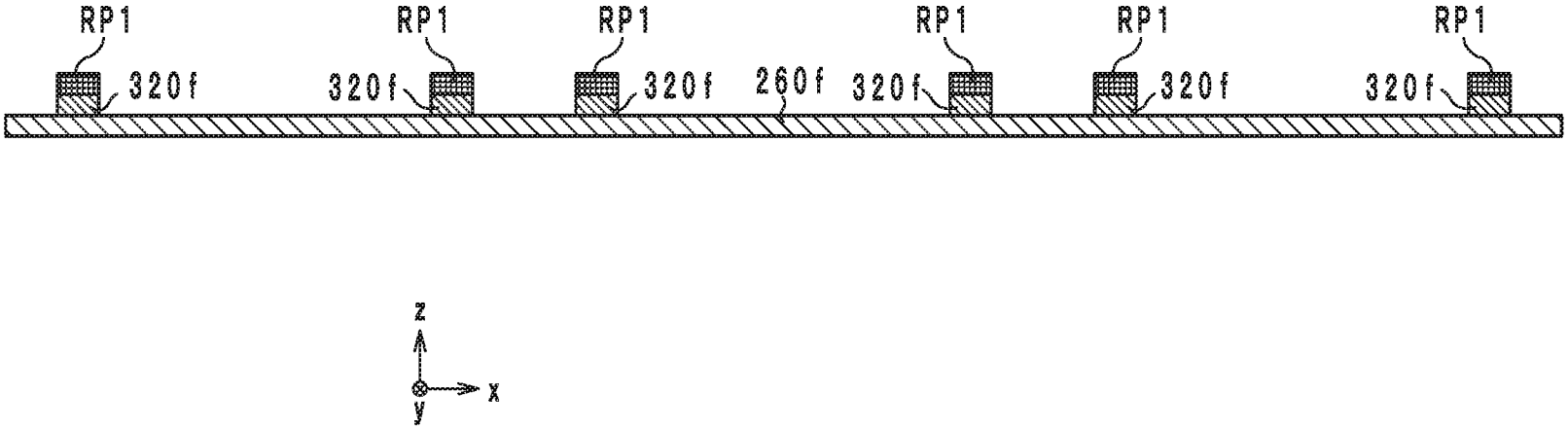
FIG. 8 is a sectional view of the electronic component 10 at a step of the production process thereof.
Figure 9:
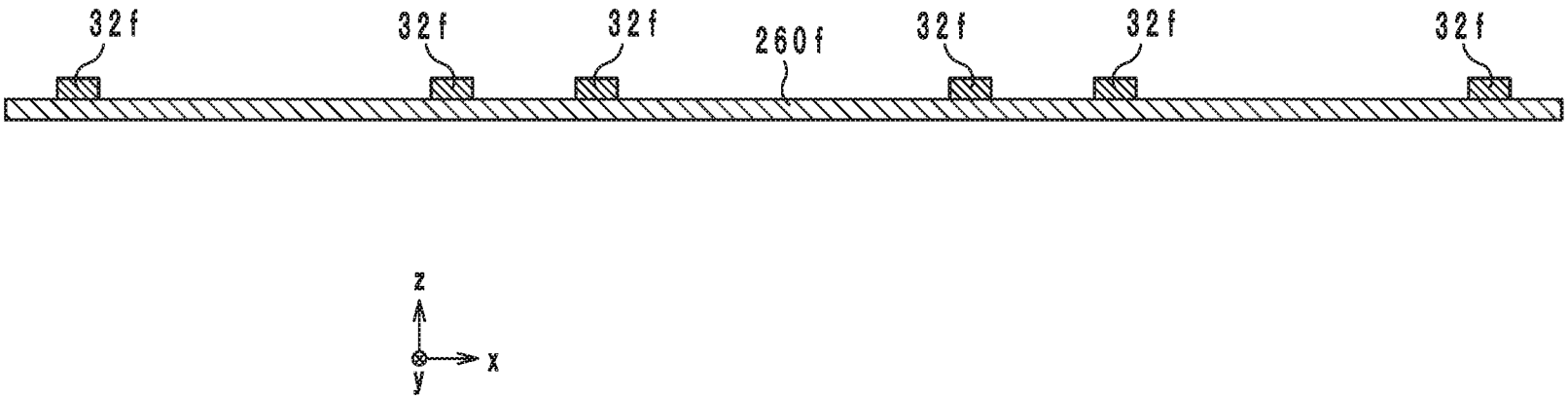
FIG. 9 is a sectional view of the electronic component 10 at a step of the production process thereof.

Wet etching is applied to the Cu foil 320*f* with the resist pattern RP1 formed thereon so as to remove the bare portions (the portions not covered by the resist pattern RP1) of the Cu foil 320*f* as illustrated in FIG. 8. In this regard, milling or the like may be adopted instead of wet etching. Next, the residual solution used for the wet etching is rinsed off with water. Further, the resist pattern RP1 is removed from the Cu foil 320*f* by a remover. Thereafter, the residual remover is rinsed off with water, and the resin sheet 260*f* is dried. By the process above, as illustrated in FIG. 9, a conductive pattern corresponding to the coil conductor 32*f* of the electronic component 10 is formed on the resin sheet 260*f*.

Figure 10:
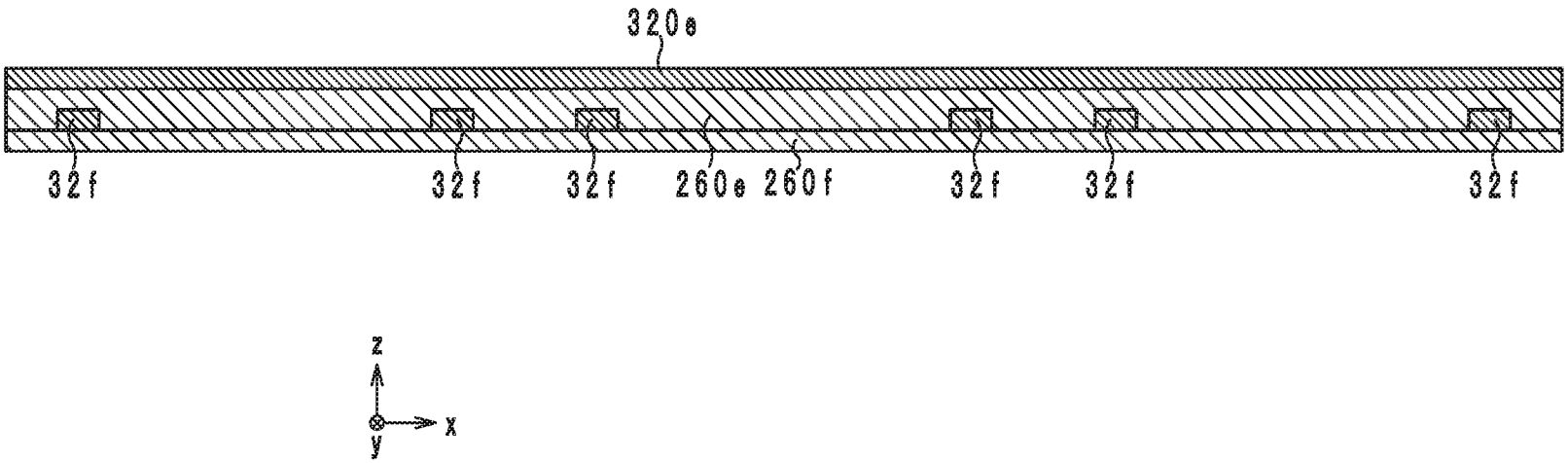
FIG. 10 is a sectional view of the electronic component 10 at a step of the production process thereof.

As illustrated in FIG. 10, a resin sheet 260*e* with a Cu foil 320*e* pressure-bonded thereto is placed on the resin sheet 260*f* with the conductive pattern thereon, and the resin sheets 260*e* and 260*f* are pressure-bonded together. The pressure bonding is carried out in the following way. Under temperature of 90 to 200 degrees C., vacuuming is carried out for 1 to 30 minutes, and pressure of 0.5 to 10 MPa is applied for 1 to 120 minutes. In this regard, in order to adjust the total thickness of the stacked and bonded resin sheets, a spacer may be used to regulate the pressure bonding. The resin sheet 260*e* pressure-bonded to the resin sheet 260*f* at this step will become the non-magnetic portion 26*e* of the electronic component 10, and the Cu foil 320*e* will become the coil conductor 32*e* of the electronic component 10. At this step, alternatively, the resin sheet 260*e* may be pressure-bonded to the resin sheet 260*f* with a conductive pattern formed thereon, and thereafter, the Cu foil 320*e* may be pressure-bonded to the resin sheet 260*e*.

Figure 11:
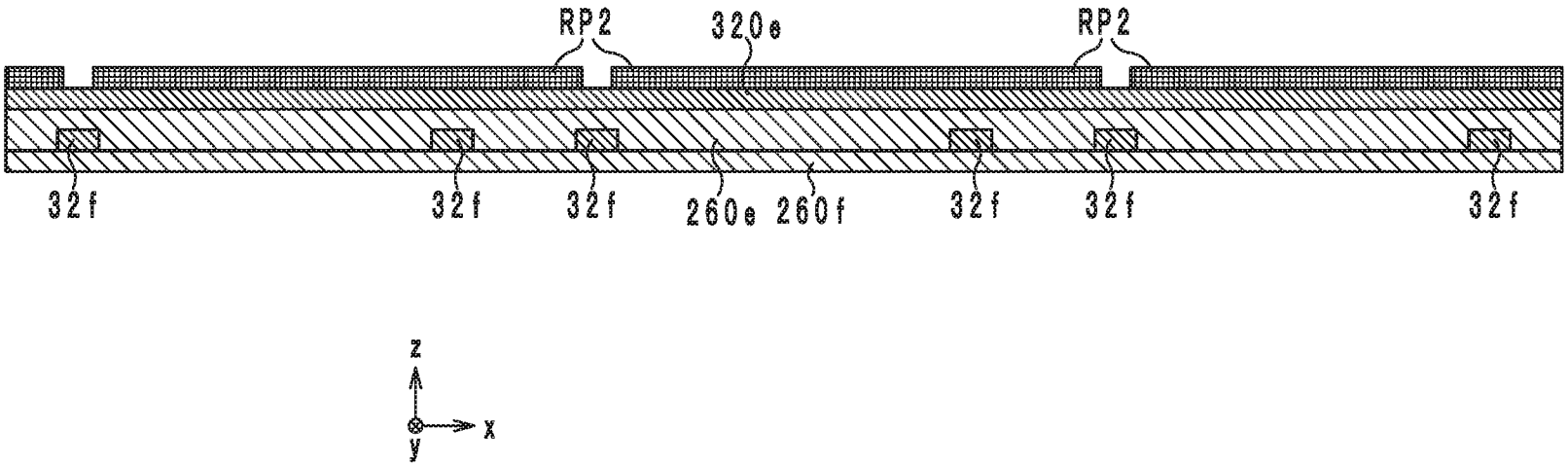
FIG. 11 is a sectional view of the electronic component 10 at a step of the production process thereof.
Figure 12:
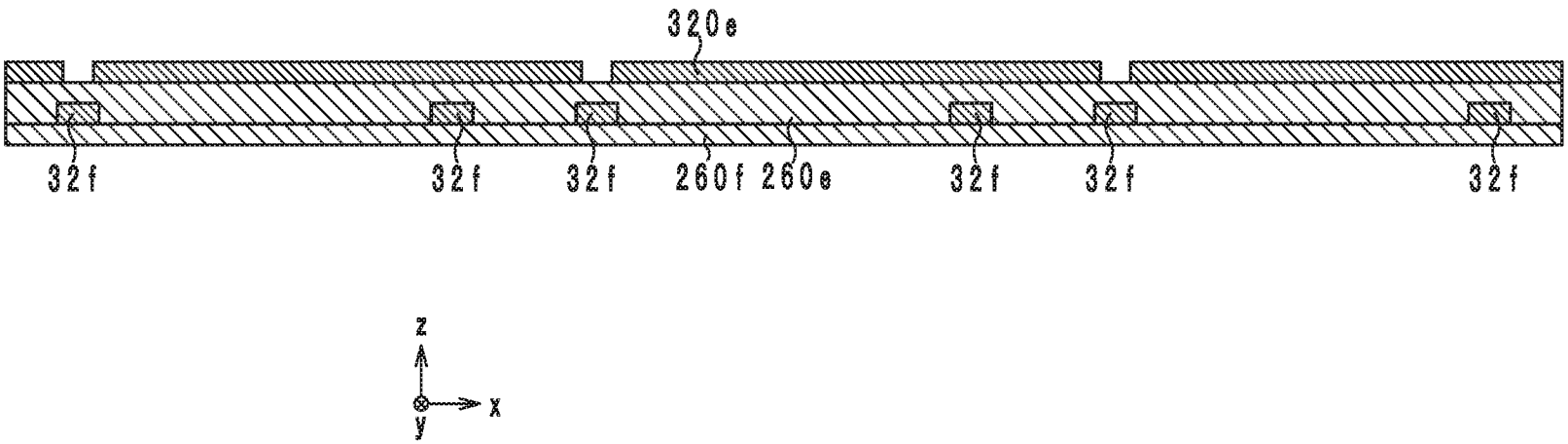
FIG. 12 is a sectional view of the electronic component 10 at a step of the production process thereof.
Figure 13:
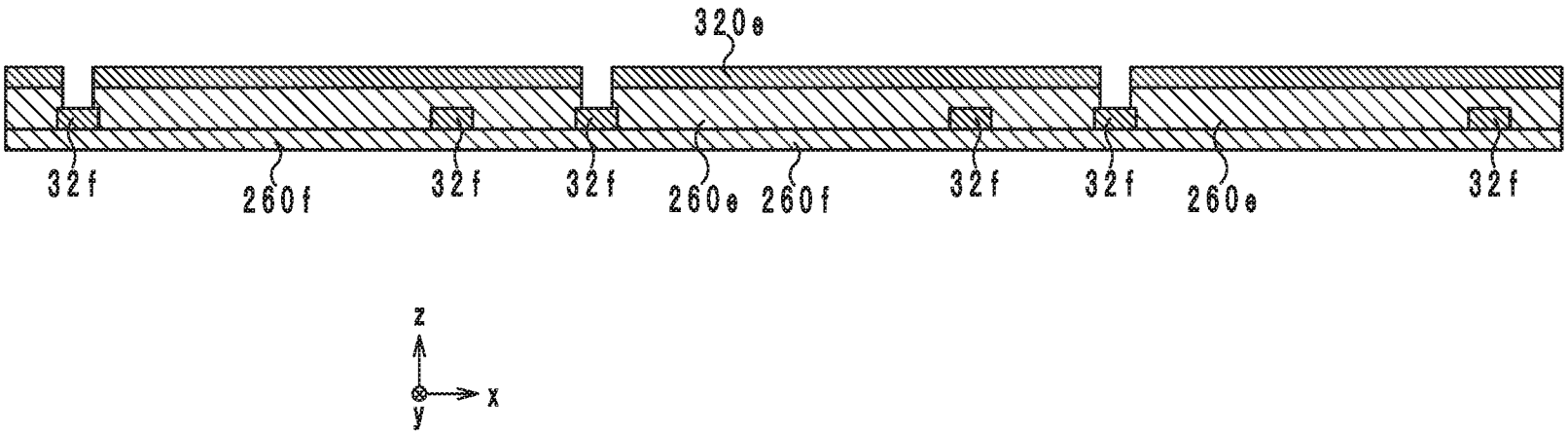
FIG. 13 is a sectional view of the electronic component 10 at a step of the production process thereof.

A via is made in the Cu foil 320*e* and the resin sheet 260*e* bonded together at the step above. The via is made in the following way. First, as illustrated in FIG. 11, a resist pattern RP2 is formed on the Cu foil 320*e*. The resist pattern RP2 is formed by following the steps of roughening the surface of the Cu foil 320*e*, laminating a film resist, exposing the film resist to light via a film mask, and developing the film resist. Next, the Cu foil 320*e* with the resist pattern RP2 formed thereon is wet-etched, and thereafter, the resist pattern RP2 is removed. In this way as illustrated in FIG. 12, a part of a via is formed in the Cu foil 320*e*. Thereafter, the bare portions of the resin sheet 260*e* (the portions that became bare by the etching of the Cu foil 320*e*) are irradiated with a laser, and thereby as illustrated in FIG. 13, a via piercing though the Cu foil 320*e* and the resin sheet 260*e* is formed. It is possible to form a via by drilling, dissolution, blasting, etc. However, since a Cu foil reflects laser, it is possible to reduce the risk of formation of unnecessary vias in the Cu foil by adopting laser irradiation for formation of a via in the resin sheet 260*e*. Thereafter, in order to remove smear that was generated by the via formation, a desmear treatment is applied. The conditions for formation of the resist pattern RP2 and etching of the Cu foil 320*e* are the same as the conditions for formation of the resist pattern RP1 and etching of the Cu film 320*f*.

Figure 14:
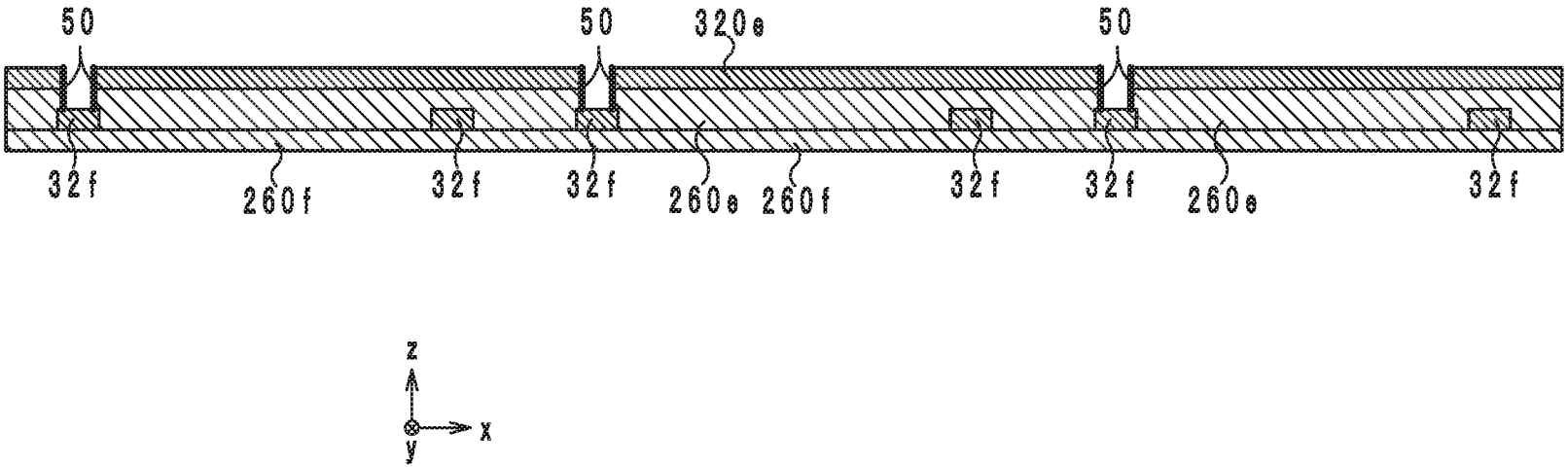
FIG. 14 is a sectional view of the electronic component 10 at a step of the production process thereof.
Figure 15:
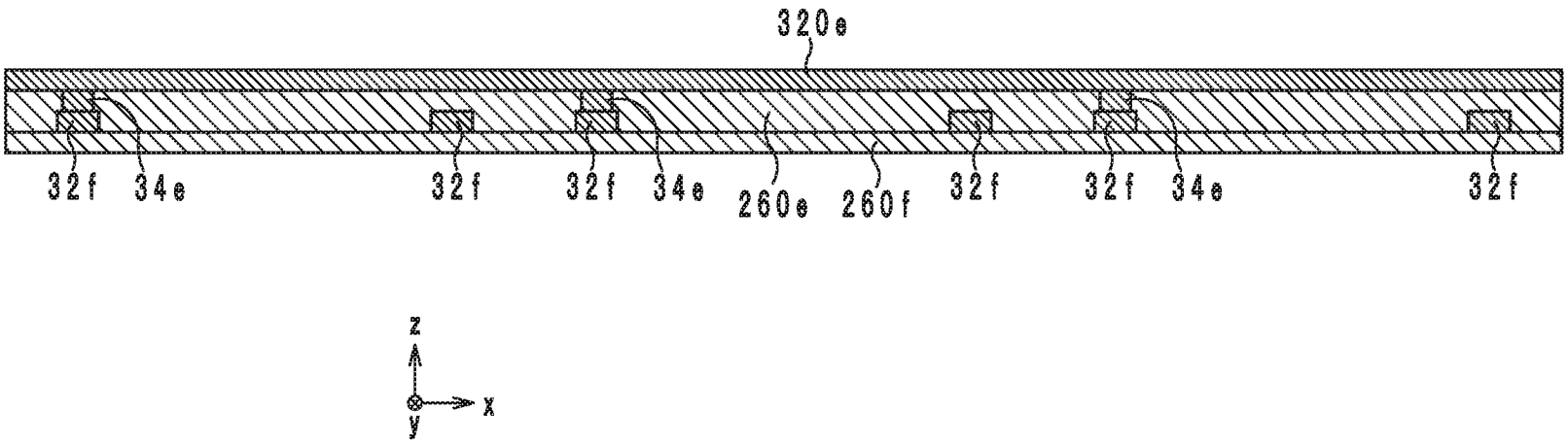
FIG. 15 is a sectional view of the electronic component 10 at a step of the production process thereof.

Next, the via is plated to permit the via to function as a via conductor connecting the Cu foil 320*e* to the conductive pattern corresponding to the coil conductor 32*f*. The via is plated in the following way. First, as illustrated in FIG. 14, a seed layer 50 is formed on the inner surface of the via. By carrying out electrolytic copper plating while using the seed layer as a base, as illustrated in FIG. 15, a via conductor connecting the Cu foil 320*e* to the conductive pattern corresponding to the coil conductor 32*f* is formed. The via conductor formed at this step corresponds to the via conductor 34*e*.

Figure 16:
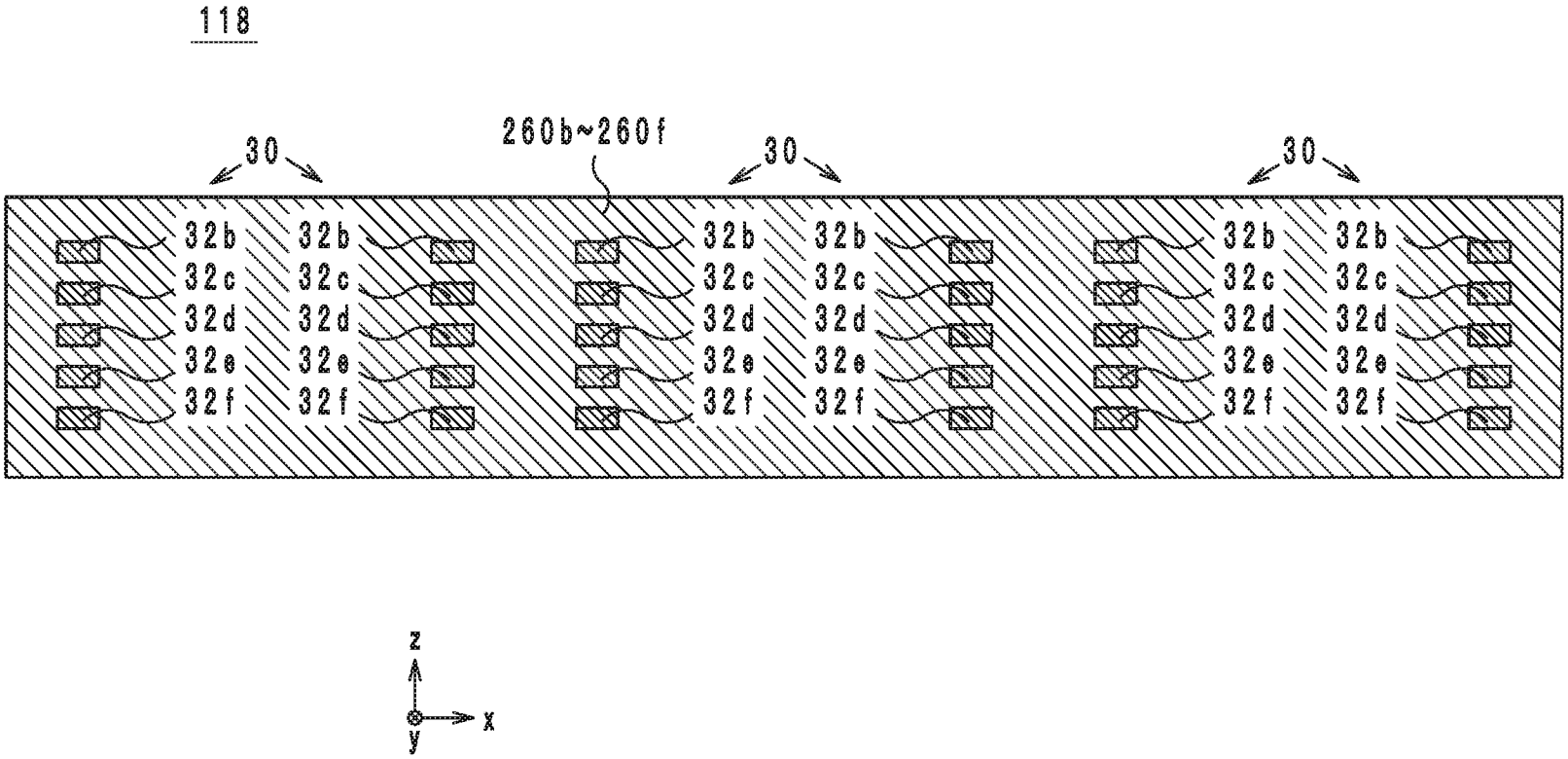
FIG. 16 is a sectional view of the electronic component 10 at a step of the production process thereof.
Figure 17:
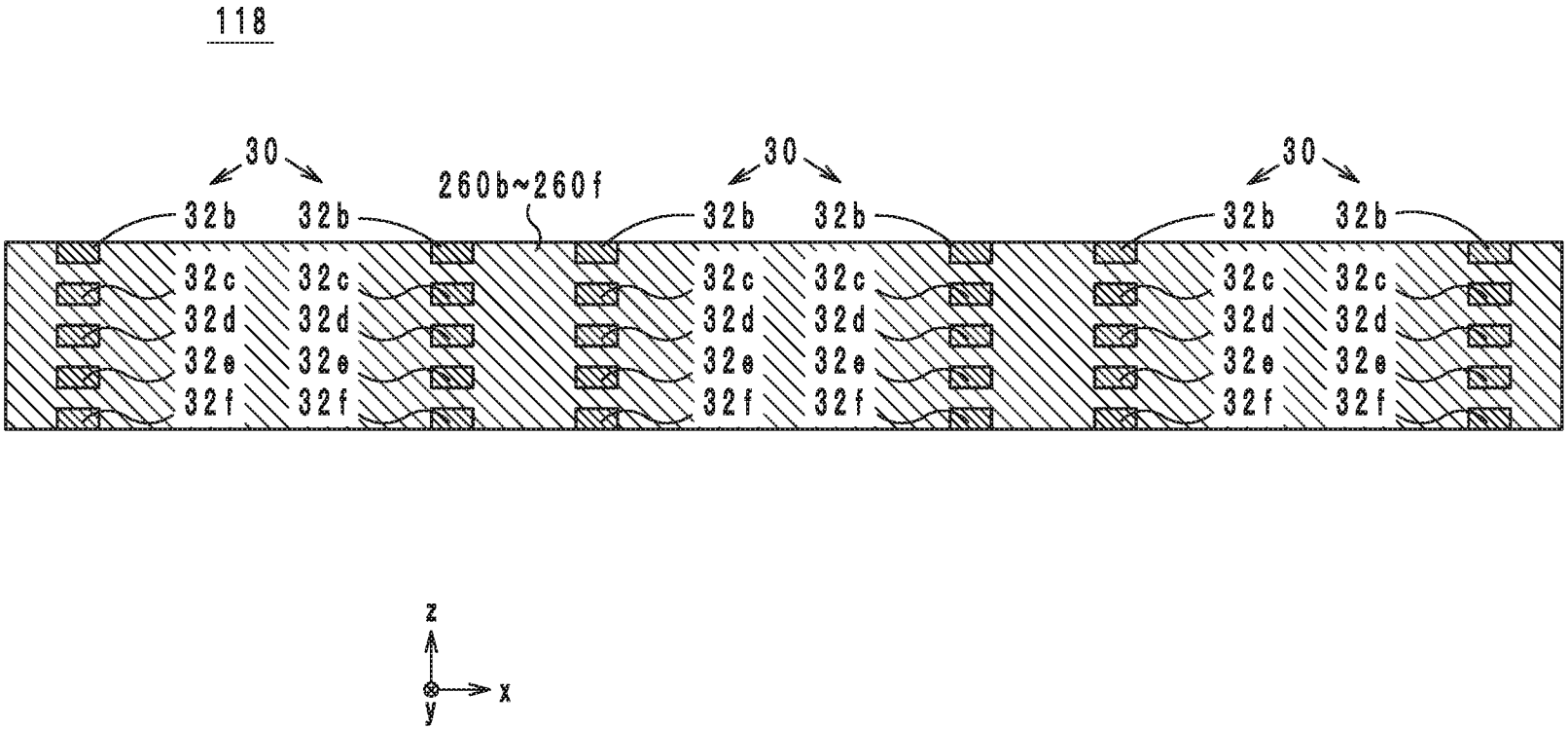
FIG. 17 is a sectional view of the electronic component 10 at a step of the production process thereof.

After forming the via conductor, the above-described process, which includes the steps of forming a conductive pattern by etching the uppermost Cu foil, pressure bonding another resin sheet with a Cu foil thereon, and forming a via and a via conductor, is repeated, and lastly, a resin sheet is pressure-bonded. Thereby, as illustrated in FIG. 16, a non-magnetic coil aggregate 118 including coils 30 is made. After the making of the coil aggregate 118, in order to smoothen the surface of the coil aggregate 118, resin on the surface of the coil aggregate 118 is removed by buff polishing, etching, grinding, CMP (chemical mechanical polishing) or the like. Thereby, the non-magnetic layers on the upper side and on the lower side of the coils 30 of the coil aggregate 118 are removed as illustrated in FIG. 17.

Figure 18:
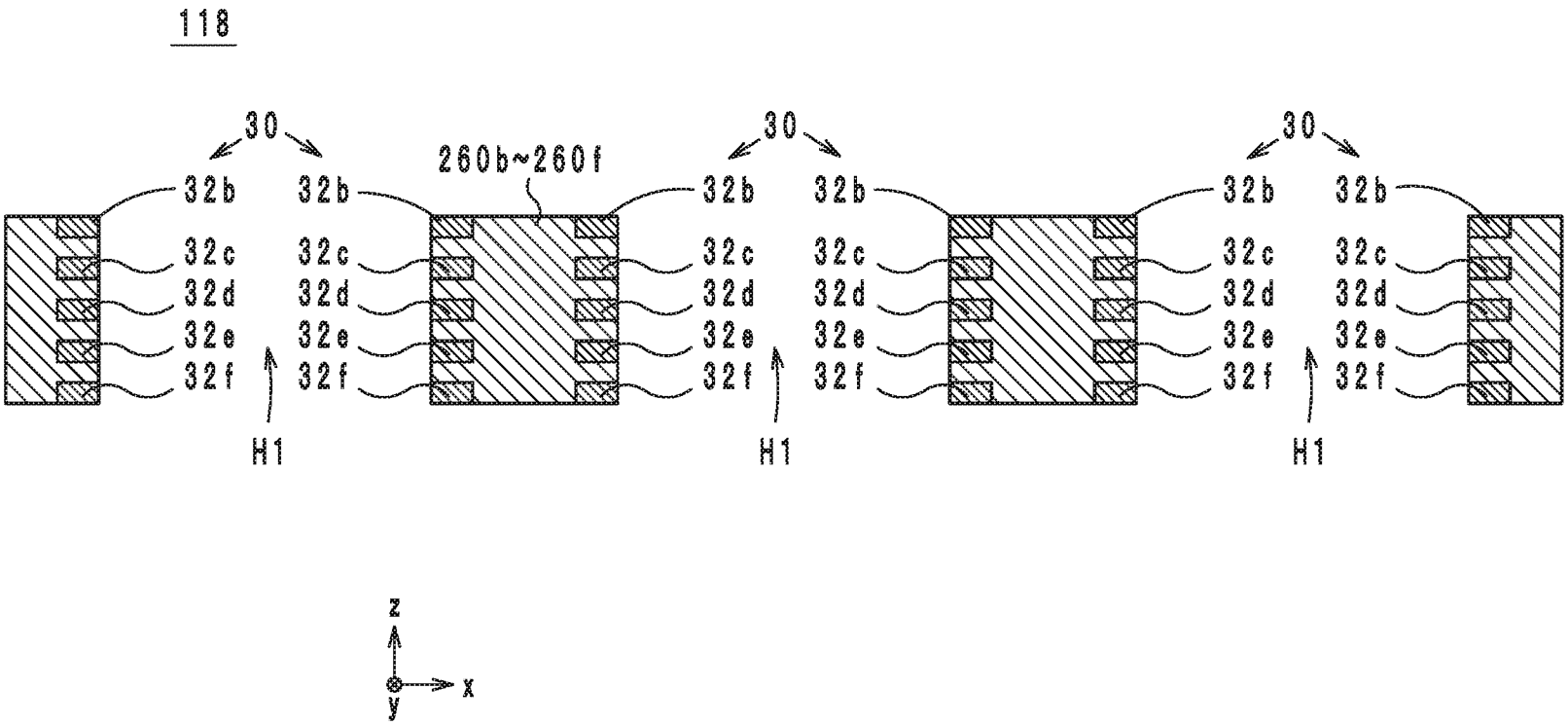
FIG. 18 is a sectional view of the electronic component 10 at a step of the production process thereof.
Figure 19:
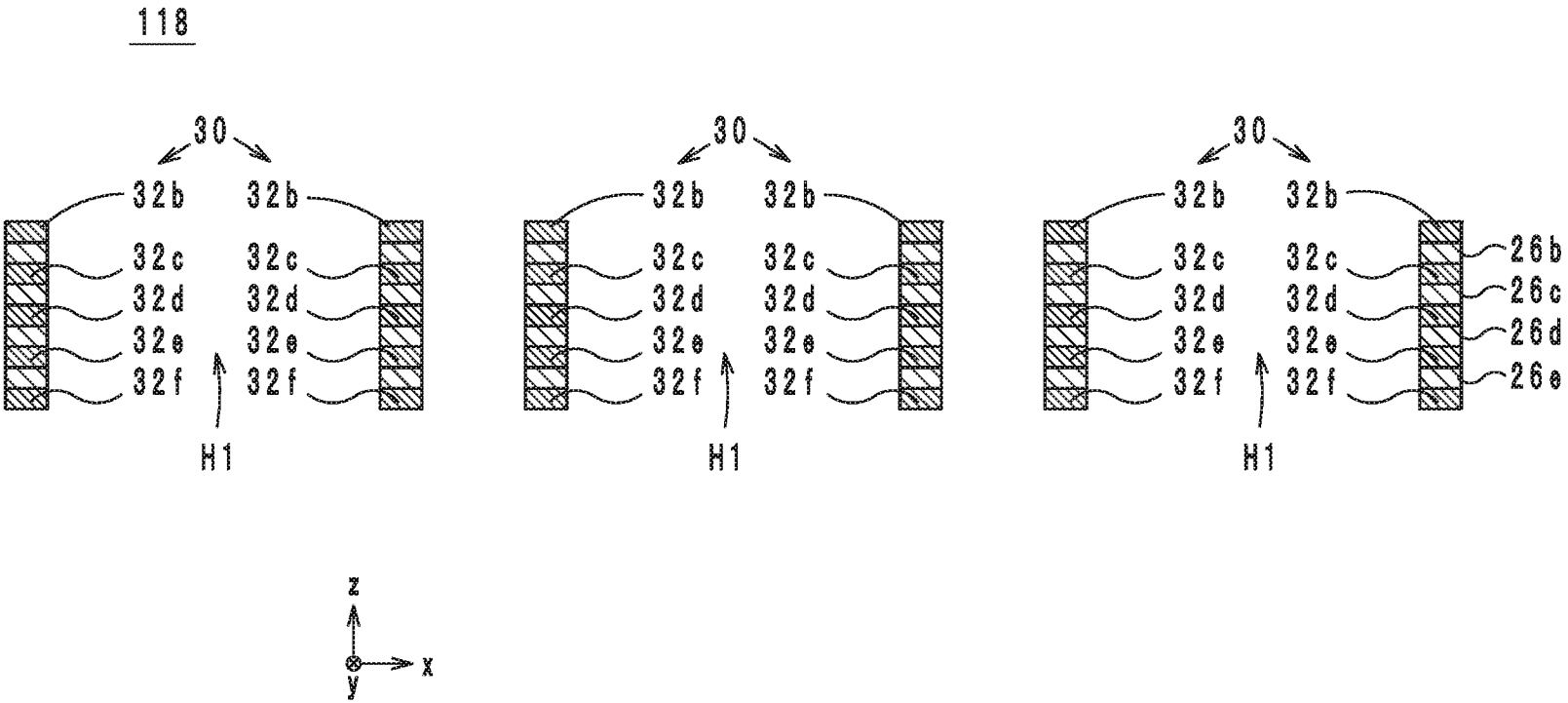
FIG. 19 is a sectional view of the electronic component 10 at a step of the production process thereof.

Next, as illustrated in FIG. 18, the portions enclosed by the respective coils 30 of the coil aggregate 118 are sandblasted, and through-holes H1 are made. Further, as illustrated in FIG. 19, the resin outside the respective coils 30 is removed by dicing, laser irradiation, blasting or the like. Thereby the non-magnetic portions 26*b*-26*e* are formed. Alternatively the through holes H1 may be formed by laser radiation, punching or the like.

Figure 20:
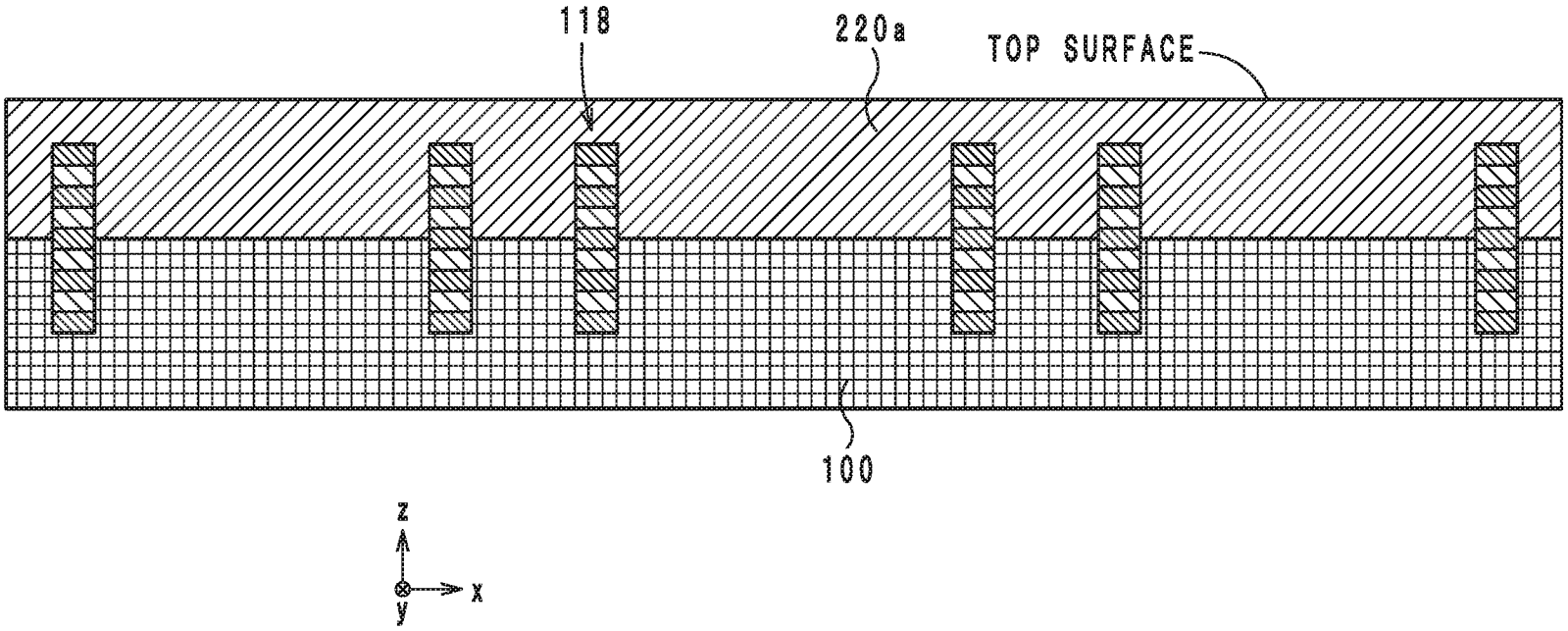
FIG. 20 is a sectional view of the electronic component 10 at a step of the production process thereof.

Next, as illustrated in FIG. 20, the coil aggregate 118 including only the coils 30 and the non-magnetic portions 26*b*-26*e* (which will hereinafter be referred to as merely coil aggregate 118) is set in a mold 100. Then, a resin sheet 220*a* containing metal magnetic particles is placed on top of the coil aggregate 118, and the resin sheet 220*a* is pressed down. Thereby the upper half of the coil aggregate 118 becomes buried in the resin sheet 220*a*. The metal magnetic particles contained in the resin sheet 220*a* are made of a metal magnetic material, for example, a Fe—Si—Cr alloy, Fe (carbonyl) or the like. Also, the main component of the resin sheet 220*a* may be epoxy resin or the like. The resin sheet 220*a* is magnetic, and will become an insulating layer 22*a* and magnetic portions 24*b* and 24*c* of the electronic component 10 later.

Figure 21:
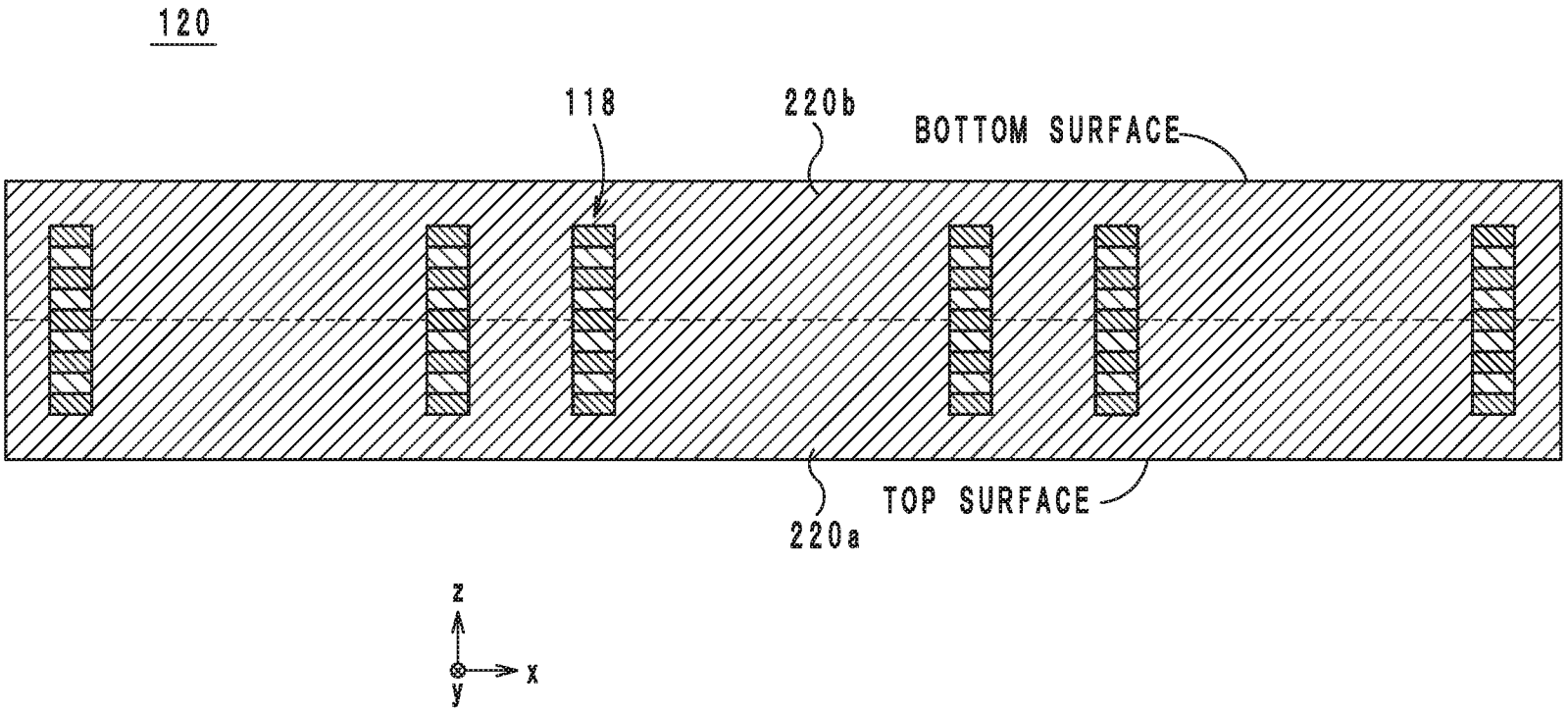
FIG. 21 is a sectional view of the electronic component 10 at a step of the production process thereof.

Next, as illustrated in FIG. 21, the coil aggregate 118 with its upper half buried in the resin sheet 220*a* is flipped upside down. Then, a resin sheet 220*b* containing metal magnetic particles is placed on top of the coil aggregate 118, and the resin sheet 220*b* is pressed down. Thereby, the lower half of the coil aggregate 118 is buried in the resin sheet 220*b*. The metal magnetic particles contained in the resin sheet 220*b* are made of a metal magnetic material, for example, a Fe—Si—Cr alloy, Fe (carbonyl) or the like. Also, the main component of the resin sheet 220*b* may be epoxy resin or the like. The resin sheet 220*b* is magnetic, and will become an insulating layer 22*f* and magnetic portions 24*d* and 24*e* of the electronic component 10 later. Thereafter, the coil aggregate 118 and the resin sheets 220*a* and 220*b* are heated in an oven or any other high-temperature chamber, for example, under a temperature of 130 to 200 degrees C. for 100 to 120 minutes, and a mother multilayer body 120 is produced. When the mother multilayer body 120 is viewed from the z-direction, a plurality of multilayer bodies 20 are arranged in a matrix.

Figure 22:
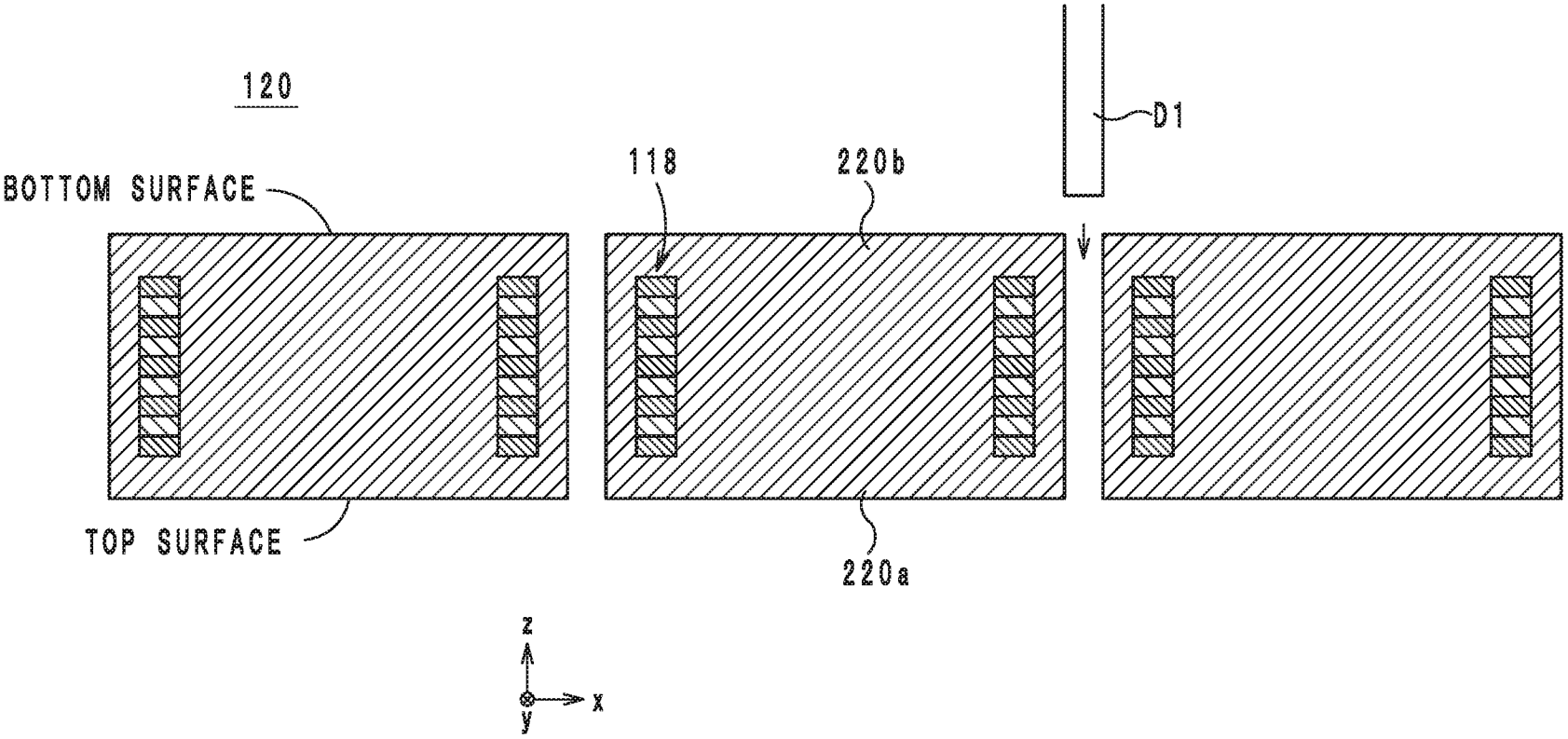
FIG. 22 is a sectional view of the electronic component 10 at a step of the production process thereof.

Next, as illustrated in FIG. 22, the mother multilayer body 120 is diced into a plurality of multilayer bodies 20 by use of a dicer D1. In this way, multilayer bodies 20 are produced.

Next, as illustrated in FIG. 23, the multilayer bodies 20 are arranged in a matrix on a plane. In this regard, the multilayer bodies 20 are placed with the bottom surfaces S2 face up and with narrow spaces therebetween. In this embodiment, with respect to two multilayer bodies 20 arranged adjacent to each other in the x-direction, the end surface S3 of one of the multilayer bodies 20 faces the end surface S4 of the other multilayer body 20. Also, with respect to two multilayer bodies 20 arranged adjacent to each other in the y-direction, the side surface S5 of one of the multilayer bodies 20 faces the side surface S6 of the other multilayer body 20.

Next, the multilayer bodies 20 arranged in a matrix as illustrated in FIG. 23 are polished by sandblasting. Specifically, an abrasive is supplied (sprayed) onto the bottom surfaces S2 of the matrix-arranged multilayer bodies 20, that is, an abrasive is sprayed downward from the upper side in FIG. 23. Thereby as illustrated in FIG. 24, the edge lines between the bottom surface S2 and the end surface S3, between the bottom surface S2 and the end surface S4, between the bottom surface S2 and the side surface S5 and between the bottom surface S2 and the side surface S6 of each of the multilayer bodies 20 are chamfered. Further, the abrasive comes into the space between the end surface S3 and the end surface S4 of two adjacent multilayer bodies 20 and polishes the end surfaces S3 and S4. In this regard, the abrasive is likely to remain near the entrance of the space, while the abrasive is unlikely to penetrate deep into the space. Therefore, the amount of abrasive on the end surfaces S3 and S4 at the negative side in the z-direction is relatively great and gradually decreases toward the positive side in the z-direction. Accordingly, the space at the negative side in the z-direction is relatively great and becomes narrower toward the positive side in the z-direction. Thus, the end surface S3 of each of the multilayer bodies 20 inclines from the z-direction so as to come closer to the end surface S4 with decreasing distance from the bottom surface S2 in the z-direction, and the end surface S4 of each of the multilayer bodies 20 inclines from the z-direction so as to come closer to the end surface S3 with decreasing distance from the bottom surface S2 in the z-direction. Also, the abrasive comes into the space between the side surface S5 and the side surface S6 of two adjacent multilayer bodies 20 and polishes the side surfaces S5 and S6. In this regard, the abrasive is likely to remain near the entrance of the space, while the abrasive is unlikely to penetrate deep into the space. Therefore, the amount of abrasive on the side surfaces S5 and S6 at the negative side in the z-direction is relatively great and gradually decreases toward the positive side in the z-direction. Accordingly, the space at the negative side in the z-direction is relatively great and becomes narrower toward the positive side in the z-direction. Thus, the side surface S5 of each of the multilayer bodies 20 inclines from the z-direction so as to come closer to the side surface S6 with decreasing distance from the bottom surface S2 in the z-direction, and the end surface S6 of each of the multilayer bodies 20 inclines from the z-direction so as to come closer to the side surface S5 with decreasing distance from the bottom surface S2 in the z-direction.

Next, as illustrated in FIG. 25, masks 102 having openings are placed on the bottom surfaces S2 of the multilayer bodies 20 such that the openings are positioned in places where the external electrodes 40*a* and 40*b* are to be formed. Specifically, a plurality of strip-shaped masks 102 extending in the y-direction are placed on the respective rows, each extending in the y-direction, of multilayer bodies 20. In this regard, each of the masks 102 is placed so as not to cover both short sides (sides on both sides in the x-direction) and the neighboring portions of the bottom surface S2 of each of the multilayer bodies 20.

Next, as illustrated in FIG. 25, with the masks 102 placed on the matrix-arranged multilayer bodies 20, an electrode material (Ti and Cu) is supplied onto the bottom surfaces S2 of the multilayer bodies 20 (supplied downward from the upper side in FIG. 25), and thereby, underlayers for the external electrodes 40*a* and 40*h* are formed. The underlayers are formed by sputtering, vapor deposition or the like.

In this moment, the electrode material comes into the space between the end surfaces S3 and S4 of adjacent multilayer bodies 20, and underlayers are formed on the end surfaces S3 and S4. The electrode material is likely to remain near the entrance of the space, while the electrode material is unlikely to penetrate deep into the space. Therefore, the film thicknesses of the underlayers at the negative side in the z-direction are relatively great and gradually decrease toward the positive side in the z-direction. Accordingly, the contact portions 44*a* and 44*b* become thicker with decreasing distance from the bottom surface S2 in the z-direction.

Also, the electrode material comes into the space between the side surfaces S5 and S6 of adjacent multilayer bodies 20, and underlayers are formed on the side surfaces S5 and S6. The electrode material is likely to remain near the entrance of the space, while the electrode material is unlikely to penetrate deep into the space. Therefore, the film thicknesses of the underlayers at the negative side in the z-direction are relatively great and gradually decrease toward the positive side in the z-direction. Accordingly, the contact portions 46*a*, 46*b*, 48*a* and 48*b* become thicker with decreasing distance from the bottom surface S2 in the z-direction.

Thereafter, the underlayers for the external electrodes 40*a* and 40*b* are barrel-plated with Ni/Sn. Through the process above, the electronic component 10 is produced.

Effects

In the electronic component 10 structured above, the external electrodes have enhanced strength. Also, the production method described above permits production of an electronic component with external electrodes having enhanced strength. This effect will hereafter be described with the external electrode 40*a* taken as an example.

In the electronic component 10, the external electrode 40*a* is provided on the end surface S3 and the bottom surface S2. The thickness of the contact portion 44*a*, which is a portion in contact with the end surface S3, becomes greater with decreasing distance from the bottom surface S2 in the z-direction. Accordingly, the thickness of the contact portion 44*a* is the greatest at the long side of the end surface S3 on the negative side in the z-direction. Therefore, the external electrode 40*a* has a great thickness on the edge line between the end surface S3 and the bottom surface S2 and has sufficient strength. The same applies to the external electrode 40*b*.

The electronic component 10 has enhanced heat release properties. This effect will hereinafter be described with the external electrode 40*a* taken as an example.

In the electronic component 10, heat generated in the multilayer body 20 diffuses radially. In this regard, a part of the heat is conducted downward from the upper side through the contact portion 44*a* of the external electrode 40*a* and conducted to a land electrode connected to the external electrode 40*a*. While the heat is conducted downward, the heat diffuses radially.

In the electronic component 10, the thickness of the contact portion 44*a* becomes greater with decreasing distance from the bottom surface S2 in the z-direction. Accordingly heat is easily conducted through the contact portion 44*a*. Thus, the electronic component 10 has enhanced heat conduction properties. The same applies to the external electrode 40*b*.

OTHER EMBODIMENTS

Various changes and modifications to the electronic component 10 and the production method thereof are possible within the scope of the present disclosure.

In the electronic component 10, the entire end surface S3 is inclined from the z-direction, as shown, for example, in FIG. 3D (e.g., the first portion in FIG. 3D). However, only a part of the end surface S3 may be inclined from the z-direction, as shown, for example, in FIG. 3E (e.g., the first portion in FIG. 3E). Specifically, as shown in FIG. 3E, it is only necessary that a part of the end surface S3 within a predetermined distance from the bottom surface S2 in the z-direction be inclined from the z-direction so as to come closer to the end surface S4 with decreasing distance from the bottom surface S2 in the z-direction. In this case, the contact portion 44*a* of the external electrode 40*a* may cover the entire end surface S3 or may cover only the part of the end surface S3 within the predetermined distance from the bottom surface S2 in the z-direction. In a case in which the contact portion 44*a* covers only the part of the end surface S3 within the predetermined distance from the bottom surface S2 in the z-direction, it is only necessary that the thickness of the contact portion 44*a* covering the part of the end surface S3 within the predetermined distance from the bottom surface S2 in the z-direction become greater with decreasing distance from the bottom surface S2 in the z-direction. The same applies to the end surface S4 and the contact portion 44*b*.

In the electronic component 10, the entire side surface S5 is inclined from the z-direction. However, only a part of the side surface S5 may be inclined from the z-direction. Specifically, it is only necessary that a part of the side surface S5 within a predetermined distance from the bottom surface S2 in the z-direction be inclined from the z-direction so as to come closer to the side surface S6 with decreasing distance from the bottom surface S2 in the z-direction. In this case, the contact portion 46*a* of the external electrode 40*a* may reach the long side of the side surface S5 on the positive side in the z-direction or may terminate at the position of the side surface S5 at the predetermined distance from the bottom surface S2 in the z-direction. In a case in which the contact portion 46*a* terminates at the position of the side surface S5 at the predetermined distance from the bottom surface S2 in the z-direction, it is only necessary that the thickness of the contact portion 46*a* in contact with the part of the side surface S5 within the predetermined distance from the bottom surface S2 in the z-direction become greater with decreasing distance from the bottom surface S2 in the z-direction. The same applies to the side surface S5 and the contact portion 46*b*, to the side surface S6 and the contact portion 48*a* and to the side surface S6 and the contact portion 48*b*.

The multilayer body 20 may be made of an inorganic oxide (glass).

The electronic component 10 may be produced by carrying out molding by use of resin to encapsulate a coil having a spirally wound flat square wire.

In the electronic component 10, the coil 30 is provided. However, any other circuit element, such as a capacitor, a resistor or the like may be provided in the electronic component 10.

Each of the end surfaces S3 and S4, and the side surfaces S5 and S6 needs to be polished not entirely but at least partly.

INDUSTRIAL APPLICABILITY

As thus far described, the present disclosure is useful for electronic components and production methods thereof, and the present disclosure gives an advantageous effect of improving the strength of external electrodes.

What is claimed is:

1. An electronic component comprising:

a body having a shape of a rectangular parallelepiped, the body including a first end surface and a second end surface opposed to each other and a mounting surface; and a first external electrode provided on the first end surface and the mounting surface, wherein a first portion of the first end surface inclines from a direction normal to the mounting surface so as to come closer to the second end surface as distance towards the mounting surface decreases in the normal direction, the first portion being a portion within a predetermined distance from the mounting surface in the normal direction; and a thickness in a direction orthogonal to the normal direction of a portion of the first external electrode contacting the first portion becomes greater as distance towards the mounting surface decreases in the normal direction.

2. The electronic component according to claim 1, further comprising a first side surface and a second side surface opposed to each other, wherein a second portion of the first side surface inclines from the normal direction so as to come closer to the second side surface as distance towards the mounting surface decreases in the normal direction, the second portion being a portion within the predetermined distance from the mounting surface in the normal direction;

the first external electrode is provided on the first end surface, the first side surface and the mounting surface; and a thickness in the direction orthogonal to the normal direction of a portion of the first external electrode contacting the second portion becomes greater as distance towards the mounting surface decreases in the normal direction.

3. The electronic component according to claim 1, further comprising a circuit element provided in the body and electrically connected to the first external electrode.

* * * * *